US010145635B2

(12) United States Patent
Hefer et al.

(10) Patent No.: US 10,145,635 B2
(45) Date of Patent: Dec. 4, 2018

(54) PISTOL MAGAZINE LOADER

(71) Applicant: Vista Outdoor Operations LLC, Farmington, UT (US)

(72) Inventors: Brandon T. Hefer, St. Louis, MO (US); Brandon K. Trostrud, St. Louis, MO (US); Sean Higgs, St. Louis, MO (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 15/699,325

(22) Filed: Sep. 8, 2017

(65) Prior Publication Data

US 2018/0066907 A1 Mar. 8, 2018

Related U.S. Application Data

(60) Provisional application No. 62/384,875, filed on Sep. 8, 2016.

(51) Int. Cl.
*F41A 9/83* (2006.01)

(52) U.S. Cl.
CPC ..... *F41A 9/83* (2013.01)

(58) Field of Classification Search
CPC ..... F41A 9/83
USPC ..... 42/87
See application file for complete search history.

(56) References Cited

U.S. PATENT DOCUMENTS 1,786,537 A 12/1930 Holek
1,840,477 A 1/1932 Frommer
2,014,177 A 9/1935 Herlach et al.
2,137,491 A 11/1938 Huff
2,191,130 A 2/1940 Ludwig
2,210,931 A 8/1940 Harris
2,345,593 A 4/1944 Garand
2,362,109 A 11/1944 Whitmore
2,394,033 A 2/1946 Wossum
2,403,012 A 7/1946 McPheters
2,451,521 A 10/1948 Uglum
2,452,600 A 11/1948 Pool et al.
2,462,836 A 3/1949 Barker et al.
2,466,017 A 4/1949 Farber
2,493,048 A 1/1950 Wangrow
2,514,277 A 7/1950 Donallan
2,531,387 A 11/1950 Bilodeau
2,659,173 A 11/1953 Capito
(Continued)

*Primary Examiner* — Samir Abdosh

(74) *Attorney, Agent, or Firm* — Christensen, Fonder, Dardi & Herbert PLLC

(57) ABSTRACT

Magazine loaders for sequentially loading cartridges into an uppermost cartridge space of a magazine are disclosed. A magazine loader may comprise a housing including a plurality of wall portions defining a housing cavity. The wall portions may define opposing arcuate pin receiving channels. The magazine loader may also include a pin and a tool. The pin may include a starboard end and a port end. The starboard end of the pin may be disposed inside a starboard channel and the port end of the pin may be disposed inside a port channel so that translation of the pin is constrained to movement along a path defined by the channels. An intermediate portion of the pin may extend through the bore defined by a central portion of the tool so that the tool is supported by the pin and the tool follows the path defined by the channels.

20 Claims, 27 Drawing Sheets

(56) References Cited

U.S. PATENT DOCUMENTS 2,783,570 A 3/1957 Kunz
2,803,985 A 8/1957 Hull
2,830,498 A 4/1958 Maillard
2,834,137 A 5/1958 Kunz
2,856,720 A 10/1958 Kunz
2,862,324 A 12/1958 Ball
2,885,811 A 5/1959 Womble, Jr.
2,887,811 A 5/1959 Johnson, Jr.
3,045,525 A 7/1962 Stadelmann
3,509,655 A 5/1970 Wilhelm
3,526,028 A 9/1970 Winch
3,710,497 A 1/1973 Musgrave
3,789,531 A 2/1974 Kersten
3,854,232 A 12/1974 Musgrave
3,939,590 A 2/1976 Musgrave
3,991,501 A 11/1976 Larsson
4,152,857 A 5/1979 Ketterer
4,291,483 A 9/1981 Musgrave
4,304,062 A 12/1981 Pepe et al.
4,352,254 A 10/1982 Peter et al.
4,392,321 A 7/1983 Bosworth
4,425,834 A 1/1984 Lohmann
4,452,002 A 6/1984 Musgrave
4,464,855 A 8/1984 Musgrave
4,488,371 A 12/1984 Boyles
4,538,371 A 9/1985 Howard
D282,680 S 2/1986 Boyles
4,570,371 A 2/1986 Mears
4,574,511 A 3/1986 Csongor
4,614,052 A 9/1986 Brown et al.
4,688,344 A 8/1987 Kim
4,689,909 A 9/1987 Howard
4,706,402 A 11/1987 Csongor
4,707,941 A * 11/1987 Eastman ..... F41A 9/68 42/49.02
4,719,715 A 1/1988 Howard
4,736,667 A 4/1988 Kochevar et al.
4,739,572 A 4/1988 Brandenburg
D300,549 S 4/1989 Crow
4,827,651 A 5/1989 Conkey
4,829,693 A 5/1989 Holmes
4,872,279 A 10/1989 Boat
4,879,829 A 11/1989 Miller et al.
4,888,902 A 12/1989 Knowles
4,939,862 A 7/1990 Brandenburg et al.
4,949,495 A 8/1990 Mari
4,970,820 A 11/1990 Miller et al.
4,993,180 A 2/1991 Upchurch
5,074,070 A 12/1991 Kuykendall
5,129,173 A 7/1992 Kuykendall
5,249,386 A 10/1993 Switzer
5,301,449 A 4/1994 Jackson
5,355,606 A 10/1994 Origoni
5,377,436 A 1/1995 Switzer
5,402,594 A 4/1995 Switzer
5,417,003 A 5/1995 Claveau
5,669,171 A 9/1997 Sally
D423,628 S 4/2000 Smart et al.
6,178,683 B1 1/2001 Williams
6,189,254 B1 2/2001 Steitz
6,219,953 B1 4/2001 Bentley
6,286,243 B1 9/2001 Hinton
D477,047 S 7/2003 Springer
6,678,985 B2 1/2004 Pikula
6,807,764 B1 10/2004 Phillips
6,810,616 B2 11/2004 Tal et al.
6,817,134 B2 11/2004 Newman
7,059,077 B2 6/2006 Tal et al.
7,257,919 B1 8/2007 Farley
7,383,657 B2 6/2008 Pikielny
7,487,613 B2 2/2009 Taylor
7,503,138 B2 3/2009 Tal et al.
D604,792 S 11/2009 Stanley
7,637,048 B2 12/2009 Tal et al.
7,805,874 B2 10/2010 Tal et al.
8,065,830 B2 11/2011 Twardy
8,234,810 B2 8/2012 Lee, III
8,356,441 B2 1/2013 Meinel
8,453,366 B2 6/2013 Gray
8,484,874 B2 7/2013 Kim
D700,266 S 2/2014 Tal et al.
8,650,792 B1 2/2014 Overmars
8,726,561 B1 5/2014 Hampton
8,915,007 B1 12/2014 Williams
8,931,199 B1 1/2015 Cauley, Jr. et al.
D728,065 S 4/2015 Tal et al.
9,003,687 B2 4/2015 Cauley, Jr. et al.
9,057,570 B1 6/2015 Tal et al.
9,091,500 B1 7/2015 Kim
9,115,943 B1 8/2015 Jordan
9,182,185 B2 11/2015 Hatch
9,212,859 B1 * 12/2015 Tal ..... F41A 9/83
9,239,198 B2 1/2016 McPhee
9,273,917 B1 3/2016 Buckner
D753,781 S 4/2016 Cauley, Jr. et al.
9,303,934 B1 4/2016 Kazsuk
D755,325 S 5/2016 Cauley, Jr. et al.
D770,588 S 11/2016 Cauley, Jr. et al.
D818,554 S 5/2018 Hefer et al.
D821,534 S 6/2018 Couie
2003/0046854 A1 3/2003 Urchek
2003/0226306 A1 12/2003 Hines
2004/0020096 A1 * 2/2004 Tal ..... F41A 9/83 42/87
2004/0159035 A1 8/2004 Newman
2007/0107291 A1 * 5/2007 Tal ..... F41A 9/83 42/87
2007/0137086 A1 6/2007 Price
2008/0184608 A1 * 8/2008 Tal ..... F41A 9/83 42/87
2012/0192477 A1 8/2012 Kim
2012/0222343 A1 9/2012 Kim
2013/0061505 A1 3/2013 Faifer
2013/0232843 A1 9/2013 Bajuelo
2014/0033592 A1 2/2014 Fiorucci
2014/0223792 A1 8/2014 Socivoi
2014/0298704 A1 10/2014 Niccum
2014/0311008 A1 10/2014 McPhee
2015/0316341 A1 11/2015 Aguilar
2015/0377573 A1 12/2015 Niccum
2016/0025437 A1 1/2016 Slocum
2016/0102932 A1 4/2016 Cobb
2017/0051992 A1 2/2017 Cottrell et al.
2018/0058785 A1 3/2018 Hefer et al.

* cited by examiner

PISTOL MAGAZINE LOADER

CROSS-REFERENCE TO RELATED APPLICATION

This application claims the benefit of U.S. Provisional Patent Application No. 62/384,875, filed Sep. 8, 2016, the disclosure of which is incorporated by reference herein.

BACKGROUND OF THE DISCLOSURE

In order to maintain their proficiency with various types of firearms, military personnel, law enforcement officers and hunters frequently engage in target practice. Target practice is often performed at a shooting range with 300 or more cartridges being fired at each practice session. In the sport of hunting, marksmanship is practiced so that a shot can be carefully placed to ensure a quick, clean and humane kill. For military personnel, good marksmanship may make the difference between victory and defeat in battlefield situations.

Many firearms, including pistols and rifles, are designed to utilize a removable magazine that holds ammunition cartridges. The use of a magazine allows a plurality of cartridges to be easily loaded into the firearm by inserting a single magazine into the firearm. After each cartridge is fired, a manually or automatically operated mechanism moves the bolt of the firearm backward and then forward again. The upper most cartridge in the magazine is pulled off of a stack of cartridges each time the mechanism cycles so that cartridges are fed one-by-one into the firing chamber of the firearm. Each magazine typically has an elongate housing defining a chamber with a spring loaded follower slidably disposed therein. The force of the spring loaded follower urges each cartridge in the magazine toward the upper most position in the where the bolt can push it into the firing chamber. When all of the cartridges have been fired, the empty magazine is removed from the firearm and a new magazine is inserted in its place. The empty magazine may then be refilled with cartridges.

SUMMARY

Magazine loaders for sequentially loading cartridges into an uppermost cartridge space of a magazine are disclosed. In an embodiment, a magazine loader comprises a housing having a top end and a bottom end. The housing may include a plurality of wall portions defining a housing cavity with an upper loading opening proximate the top end and a bottom opening proximate the bottom end. The housing cavity may be configured to receive an upper portion of the magazine. The housing cavity extends along a magazine insertion and withdrawal axis in one or more embodiments. The plurality of wall portions may comprise a starboard wall portion and an opposing port wall portion. In an embodiment, the wall portions define opposing arcuate pin receiving channels. The magazine loader may also include a pin and a tool disposed between the starboard wall portion and the port wall portion. In some embodiments, the tool comprises a central portion defining a bore, a first arm extending away from the bore and a second arm displaced forwardly from the first arm. The pin may include a starboard end, a port end and an intermediate portion extending between the starboard end and the port end. In some embodiments, the starboard end of the pin is disposed inside a starboard channel and the port end of the pin being disposed inside a port channel so that translation of the pin is constrained to movement along a path defined by the channels. The intermediate portion of the pin may extend through the bore defined by the central portion of the tool so that the tool is supported by the pin and the pin follows the path defined by the channels. When a cartridge is inserted through the upper loading opening, the cartridge may effect a rearwardly directed force to the first arm of the tool causing the tool to rotate about a pin axis until the second arm of the tool contacts a protrusion of the housing and further application of the rearwardly directed force to the first arm may cause the pin to move forwardly and upwardly along the path thereby withdrawing the first arm from the uppermost cartridge space allowing the cartridge to occupy the uppermost cartridge space.

In an embodiment, a magazine loader for loading cartridges into a magazine may comprise a housing including a starboard shell and a port shell. The shells cooperate to define a bottom opening and a cavity fluidly communicating with the bottom opening. The cavity extends in an upward direction and a downward direction along a magazine insertion and removal axis. The bottom opening faces a downward direction. The housing comprises a starboard wall portion of the starboard shell and a port wall portion of the port shell disposed on opposite sides of the cavity.

The housing includes a top panel that extends in a port direction from the starboard wall portion to the port wall portion and extending in a starboard direction from the port wall portion to the starboard wall portion. The top panel comprises a top panel portion of the starboard shell and a top panel part of the port shell.

The housing further includes a front wall and a rear wall. The front wall of the housing extends in the port direction from the starboard wall portion to the port wall portion and extends in the starboard direction from the port wall portion to the starboard wall portion. The front wall comprises a front wall portion of the starboard shell and a front wall part of the port shell. The rear wall of the housing extends in the port direction from the starboard wall portion to the port wall portion and extends in the starboard direction from the port wall portion to the starboard wall portion. The rear wall extends in the upward direction from the bottom opening to the top panel and extends in the downward direction from the top panel to the bottom opening. The rear wall comprises a rear wall portion of the starboard shell and a rear wall part of the port shell. The starboard wall portion of the starboard shell extends in the forward direction from the rear wall portion to the front wall portion and extends in the rearward direction from the rear wall portion to the front wall portion. The port wall portion of the port shell extends in the forward direction from the rear wall part to the front wall part and extends in the rearward direction from the rear wall part to the front wall part.

The magazine loader includes a tool disposed between the starboard wall portion and the port wall portion. The tool comprises a tool body including a central portion and a first arm extending generally downward from the central portion. The tool comprises a starboard flange and a port flange. The starboard flange and a port flange both extend generally upward from the central portion of the tool body. The starboard flange and the port flange are disposed on opposite sides of a notch. The notch is defined by an inner surface of the starboard flange, an inner surface of the port flange, and a central surface of the central portion. The central surface extends between the inner surface of the starboard flange and the inner surface of the port flange. The starboard flange defines a starboard bore disposed on a starboard side of the tool notch. The starboard bore is disposed in fluid communication with the notch. The port flange defines a port bore disposed on a port side of the tool notch. The port bore is disposed in fluid communication with the notch.

The magazine loader includes a spring comprising a length of wire. The wire of the spring forms a first leg, a second leg and a first coil disposed between the first leg and the second leg. The coil of the spring is disposed between the starboard flange and the port flange. The coil defines a lumen. The wire forms a foot extending in the starboard direction from the second leg and a bend disposed between the second leg and the foot. The bend is configured so that the foot of the spring extends in the starboard direction. The foot of the spring extends into a socket defined by a boss. The boss is supported by the starboard wall portion. The boss extends away from the starboard wall portion in the port direction. The first leg of the spring is seated against the central surface of the tool.

The magazine loader includes a pin that extends through the starboard bore defined by the starboard flange, the lumen defined by the coil and the port bore defined by the port flange. The coil of the spring is disposed about the pin and located within the notch. The pin having a starboard end and a port end. The starboard end of the pin being disposed inside a starboard channel defined by a two starboard ribs, the starboard ribs both being supported by the starboard wall portion. The starboard ribs extending in the port direction away from the starboard wall portion. The starboard ribs being offset from one another so as to define the starboard channel. The starboard channel being dimensioned to receive starboard end of the pin and to constrain translation of starboard end of the pin to a curved starboard path. The port end of the pin is disposed inside a port channel. The port channel being defined by a two port ribs. The port ribs both being supported by the port wall portion. The port ribs extending in the starboard direction away from the port wall portion. The port ribs being offset from one another so as to define the port channel. The port channel being dimensioned to receive the port end of the pin and to constrain translation of the port end of the pin to a curved port path.

The spring applies a force between the starboard wall portion and the tool so that the tool is biased to move in a generally rearward direction along the curved port path defined by the port channel and the curved starboard path defined by the starboard channel. The spring applies a moment between the starboard wall portion and the tool so that the tool is biased to rotate about the pin so that a distal end of the arm swings forward.

A feature and advantage of embodiments is a magazine loader in which the force that compresses the magazine spring is provided by the larger muscles in the arm rather than the smaller muscles in the hand. Using the larger muscles of the arm rather than the smaller muscles in the hand helps to avoid muscle fatigue and possible strain or injury to the hand muscles.

A feature and advantage of embodiments is a magazine loader including an arm that depresses the spring of a magazine so that depressing the spring with the users fingers is unnecessary. Thus avoiding abrasions, nicks, cuts, and pain that may be experienced by a user when repetitively pressing depressing the spring of the magazine using fingers is avoided.

A feature and advantage of embodiments is an arrangement that causes the first arm of a magazine loader tool to be withdrawn from the uppermost cartridge space thus allowing a cartridge to occupy the uppermost cartridge space of the magazine. In an embodiment, the tool of the magazine loader moves in a first motion involving pure rotation of the tool and a second motion that includes forward and upward translation of the tool. In some useful embodiments, the forward and upward movement of the tool acts to withdraw the first arm of the tool from the uppermost cartridge space of a magazine.

A feature and advantage of embodiments involves providing a magazine loader that is capable of receiving magazines from handguns of various makes and models without requiring a user to make adjustments to the magazine loader. A cavity of the magazine loader has sufficient clearance around each magazine to provide a multi-magazine fit. For example, a user can load magazines from multiple handguns of different makes and/or models during a visit to a firing range.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIGS. 13A-13C may be collectively referred to as FIG. 13.

Figure 1:
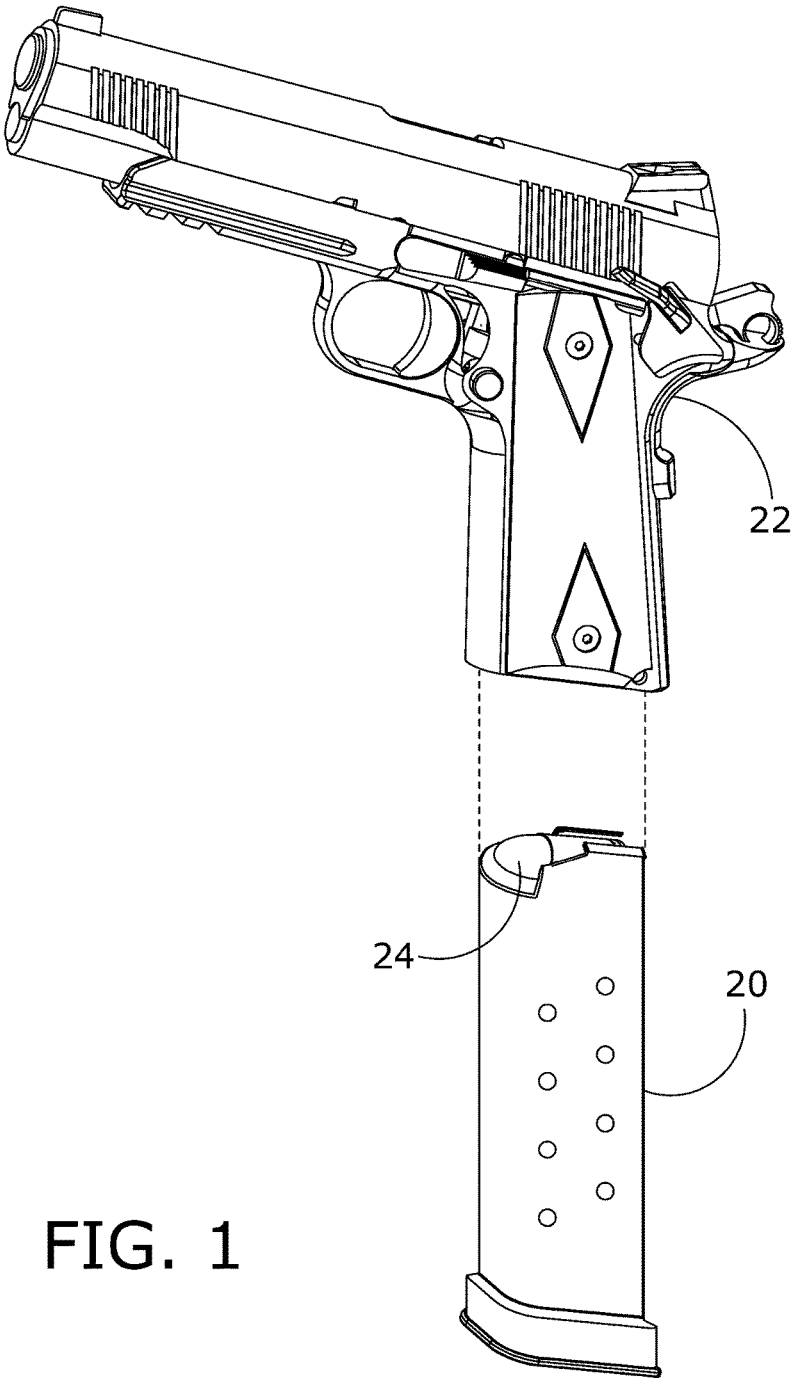
FIG. 1 is a perspective view showing a handgun and a magazine containing a stack of cartridges.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2B:
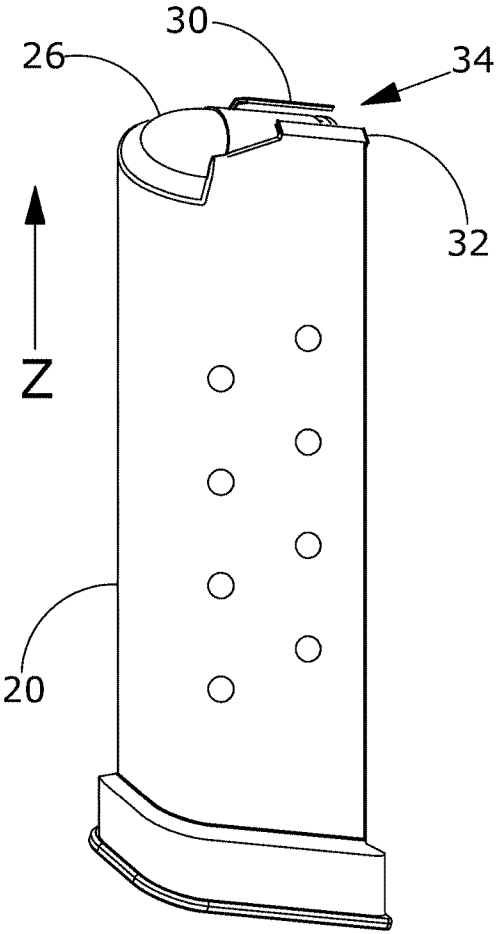
FIG. 2B is a perspective view of a magazine holding a stack of cartridges including an upper most cartridge.
Figure 2A:
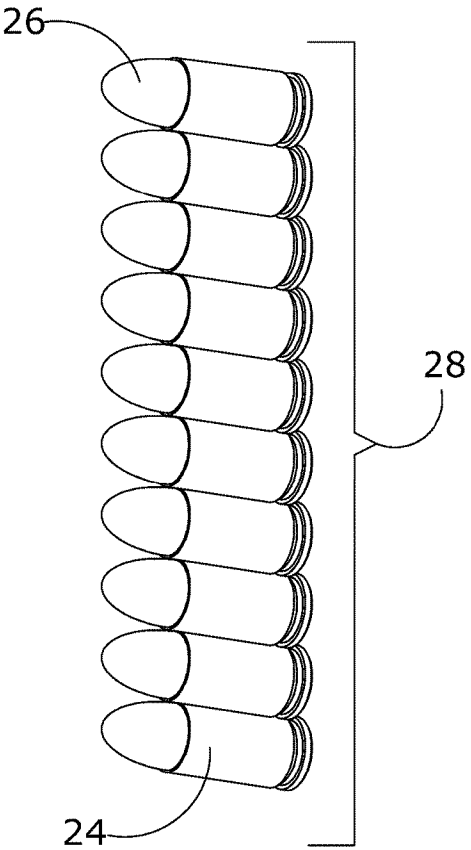
FIG. 2A is a perspective view showing a stack of cartridges including an upper most cartridge and a plurality of additional cartridges.
Figure 3:
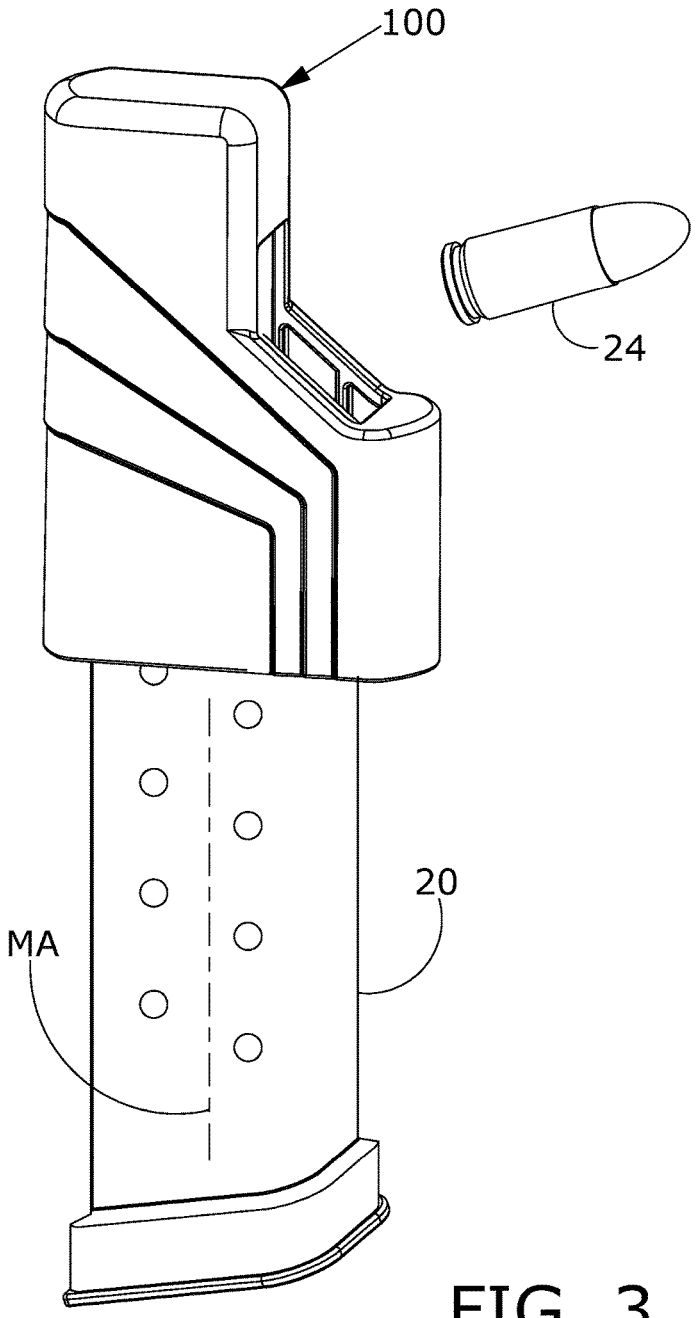
FIG. 3 is a perspective view showing a magazine loader and a magazine.

FIG. 1 is a perspective view showing a handgun 22 and a magazine 20 containing a stack of cartridges 24. The stack of cartridges 24 may be placed into the handgun 22 by inserted the magazine 20 into a cavity in the handle portion of the handgun 22. FIG. 2A is a perspective view showing a stack 28 of cartridges 24 including an uppermost cartridge 26. FIG. 2B is a perspective view of a magazine 20 holding a stack of cartridges including an uppermost cartridge 26. The magazine 20 includes a first lip 30 and a second lip 32. The first lip 30 and the second lip 32 define an upper opening 34 of the magazine 20. In the embodiment of FIG. 2B, the upper opening defined by the first lip 30 and the second lip 32 has a width that is smaller than the diameter of the uppermost cartridge 26 so that the first lip 30 and the second lip 32 prevent the uppermost cartridge 26 from exiting the magazine 20 in an upward direction. FIG. 3 is a perspective view showing a magazine loader 100 and a magazine 20. The magazine loader 100 may be used to load a plurality of cartridges 24 into the magazine.

Referring, for example, to FIGS. 4-7 and 13-15, a magazine loader 100 in accordance with an example embodiment comprises a housing 120 having a top end and a bottom end. The housing 120 may include a plurality of wall portions defining a housing cavity 124 with an upper loading opening 114 proximate the top end and a bottom opening 122 proximate the bottom end. The housing cavity 124 may be configured to receive an upper portion of the magazine 20. The housing cavity 124 extends along a magazine insertion and withdrawal axis MA in one or more embodiments. The plurality of wall portions may comprise a starboard wall portion 222 and an opposing port wall portion 322. In an embodiment, the wall portions define opposing pin receiving channels. In some embodiments, the pin receiving channels include a starboard channel 230 and a port channel 330. The magazine loader 100 may also include a pin 150 and a tool 420 disposed between the starboard wall portion 222 and the port wall portion 322. In some embodiments, the tool 420 comprises a central portion 424 defining a bore 448, 450, a first arm 426 extending away from the bore 448, 450 and a second arm 454 displaced forwardly from the first arm 426. The pin 150 may include a starboard end 152, a port end 154 and an intermediate portion extending between the starboard end 152 and the port end 154. In some embodiments, the starboard end 152 of the pin 150 is disposed inside the starboard channel 230 and the port end 154 of the pin 150 is disposed inside a port channel 330 so that translation of the pin is constrained to movement along a path 434 defined by the channels. The intermediate portion of the pin 150 may extend through the bore 448, 450 defined by the central portion 424 of the tool 420 so that the tool 420 is supported by the pin 150 and the tool 420 follows the path 434 defined by the channels. When a cartridge is inserted through the upper loading opening 114, the cartridge may effect a rearwardly directed force to the first arm 426 of the tool 420 causing the tool 420 to rotate about a pin axis 158 until the second arm 454 of the tool 420 contacts a protrusion 456 of the housing 120 and further application of the rearwardly directed force to the first arm 426 may cause the pin 150 to move forwardly and upwardly along the path 434 thereby withdrawing the first arm 426 from the uppermost cartridge space allowing the cartridge to occupy the uppermost cartridge space.

Referring, for example, to FIGS. 1-12F, a magazine loader 100 for loading cartridges into a magazine in accordance with this detailed description may comprise a housing 120 including a starboard shell 220 and a port shell 320. The shells cooperate to define a bottom opening 122 and a cavity 124 fluidly communicating with the bottom opening 122. The cavity 124 extends in an upward direction Z and a downward direction −Z along a magazine insertion and removal axis 126. The bottom opening 122 faces a downward direction −Z. The housing 120 comprises a starboard wall portion 222 of the starboard shell 220 and a port wall portion 322 of the port shell 320 disposed on opposite sides of the cavity 124. The housing 120 includes a top panel 128 that extends in a port direction −X from the starboard wall portion 222 to the port wall portion 322 and extending in a starboard direction X from the port wall portion 322 to the starboard wall portion 222. The top panel 128 comprises a top panel portion 224 of the starboard shell 220 and a top panel part 324 of the port shell 320.

The housing 120 further includes a front wall 130 and a rear wall 132. The front wall 130 of the housing 120 extends in the port direction −X from the starboard wall portion 222 to the port wall portion 322 and extends in the starboard direction X from the port wall portion 322 to the starboard wall portion 222. The front wall 130 comprises a front wall portion 226 of the starboard shell 220 and a front wall part 326 of the port shell 320. The rear wall 132 of the housing 120 extends in the port direction −X from the starboard wall portion 222 to the port wall portion 322 and extends in the starboard direction X from the port wall portion 322 to the starboard wall portion 222. The rear wall 132 extends in the upward direction Z from the bottom opening 122 to the top panel 128 and extends in the downward direction −Z from the top panel 128 to the bottom opening 122. The rear wall 132 comprises a rear wall portion 228 of the starboard shell 220 and a rear wall part 328 of the port shell 320. The starboard wall portion 222 of the starboard shell 220 extends in the forward direction Y from the rear wall portion 228 to the front wall portion 226 and extends in the rearward direction −Y from the rear wall portion 228 to the front wall portion 226. The port wall portion 322 of the port shell 320 extends in the forward direction Y from the rear wall part 328 to the front wall part 326 and extends in the rearward direction −Y from the rear wall part 328 to the front wall part.

The magazine loader 100 includes a tool 420 disposed between the starboard wall portion 222 and the port wall portion 322. The tool comprises a tool body 422 including a central portion 424 and a first arm 426 extending generally downward from the central portion 424. The tool 420 comprises a starboard flange 440 and a port flange 442. The starboard flange 440 and the port flange 442 both extend generally upward from the central portion 424 of the tool body 422. The starboard flange 440 and the port flange 442 are disposed on opposite sides of a notch 444. The notch 444 is defined by an inner surface of the starboard flange 440, an inner surface of the port flange 442, and a central surface 446 of the central portion 424. The central surface 446 extends between the inner surface of the starboard flange 440 and the inner surface of the port flange 442. The starboard flange 440 defines a starboard bore 448 disposed on a starboard side of the tool notch 444. The starboard bore 448 is disposed in fluid communication with the notch 444. The port flange 442 defines a port bore 450 disposed on a port side of the tool notch 444. The port bore 450 is disposed in fluid communication with the notch 444.

The magazine loader 100 includes a spring 134 comprising a length of wire 136. The wire 136 of the spring 134 forms a first leg 138, a second leg 140 and a coil 142 disposed between the first leg 138 and the second leg 140. The coil 142 of the spring 134 is disposed between the starboard flange 440 and the port flange 442. The coil 142 defines a lumen 144. The wire 136 forms a foot 146 extending in the starboard direction X from the second leg 140 and a bend 148 disposed between the second leg 140 and the foot 146. The bend 148 is configured so that the foot 146 of the spring 134 extends in the starboard direction X. The foot 146 of the spring 134 extends into a socket 238 defined by a boss 240. The boss 240 is supported by the starboard wall portion 222. The boss 240 extends away from the starboard wall portion 222 in the port direction −X. The first leg 138 of the spring 134 is seated against the central surface 446 of the tool 420.

The magazine loader 100 includes a pin 150 that extends through the starboard bore 448 defined by the starboard flange 440, through the lumen 144 defined by the coil 142 and through the port bore 450 defined by the port flange 442. The coil 142 of the spring is disposed about the pin 150 and located within the notch 444. The pin 150 having a starboard end 152 and a port end 154. The starboard end 152 of the pin 150 being disposed inside a starboard channel 230 defined by two starboard ribs 232, the starboard ribs 232 both being supported by the starboard wall portion 222. The starboard ribs 232 extending in the port direction −X away from the starboard wall portion 222. The starboard ribs 232 being offset from one another so as to define the starboard channel 230. The starboard channel 230 being dimensioned to receive the starboard end 152 of the pin 150 and to constrain translation of starboard end 152 of the pin 150 to a curved starboard path 234. The port end 154 of the pin 150 is disposed inside a port channel 330. The port channel 330 being defined by two port ribs 332. The port ribs 332 both being supported by the port wall portion 322. The port ribs 332 extending in the starboard direction X away from the port wall portion 322. The port ribs 332 being offset from one another so as to define the port channel 330. The port channel 330 being dimensioned to receive the port end 154 of the pin and to constrain translation of the port end 154 of the pin 150 to a curved port path 334.

The spring 134 applies a force between the starboard wall portion 222 and the tool 420 so that the tool 420 is biased to move in a generally rearward direction along the curved port path 334 defined by the port channel 330 and the curved starboard path 234 defined by the starboard channel 230. The spring 134 applies a moment between the starboard wall portion 222 and the tool 420 so that the tool 420 is biased to rotate about the pin 150 so that a distal end 428 of the arm 426 swings forward.

Figure 4:
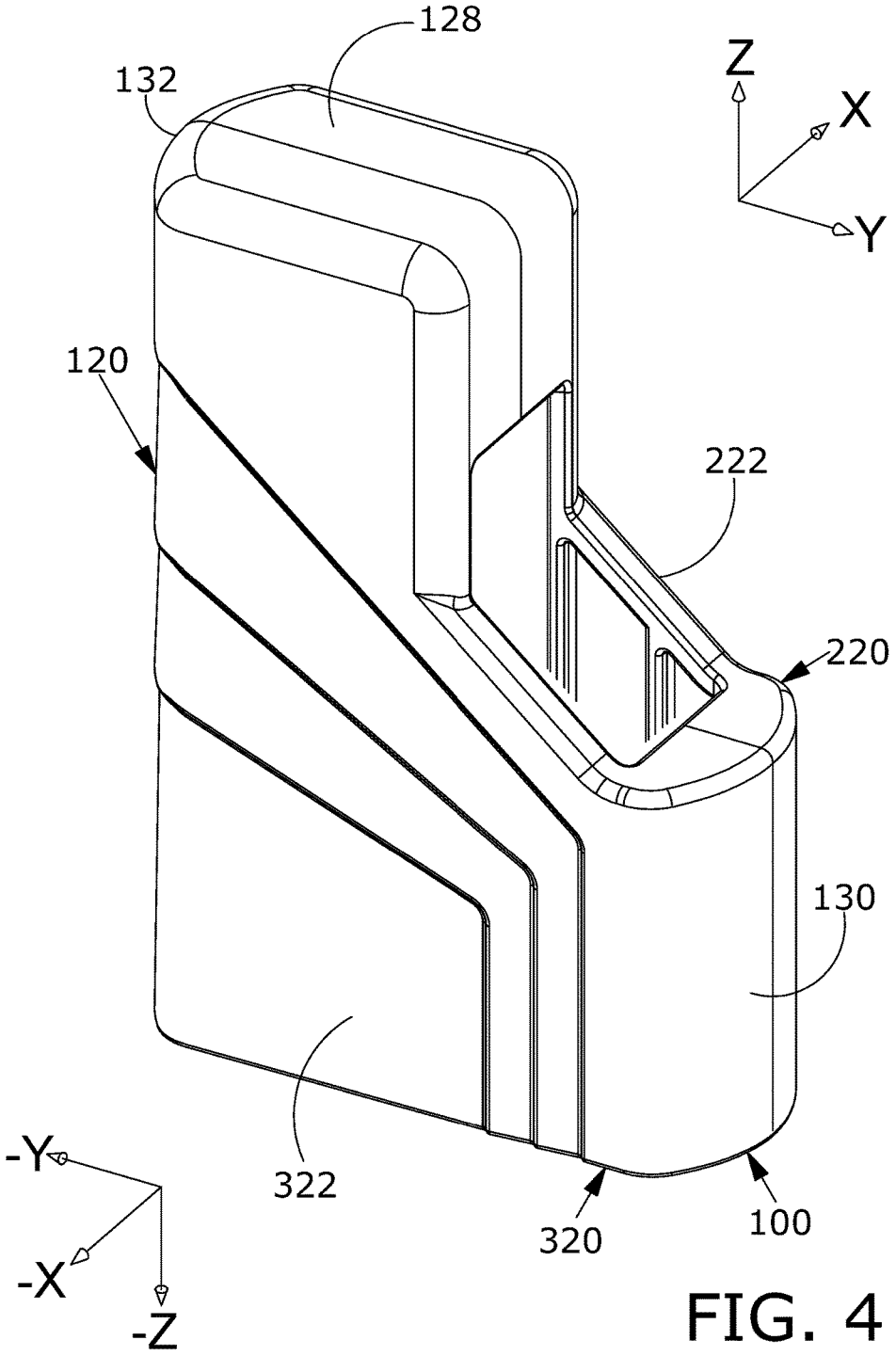
FIG. 4 is perspective views of a magazine loader in accordance with the present invention.
Figure 5:
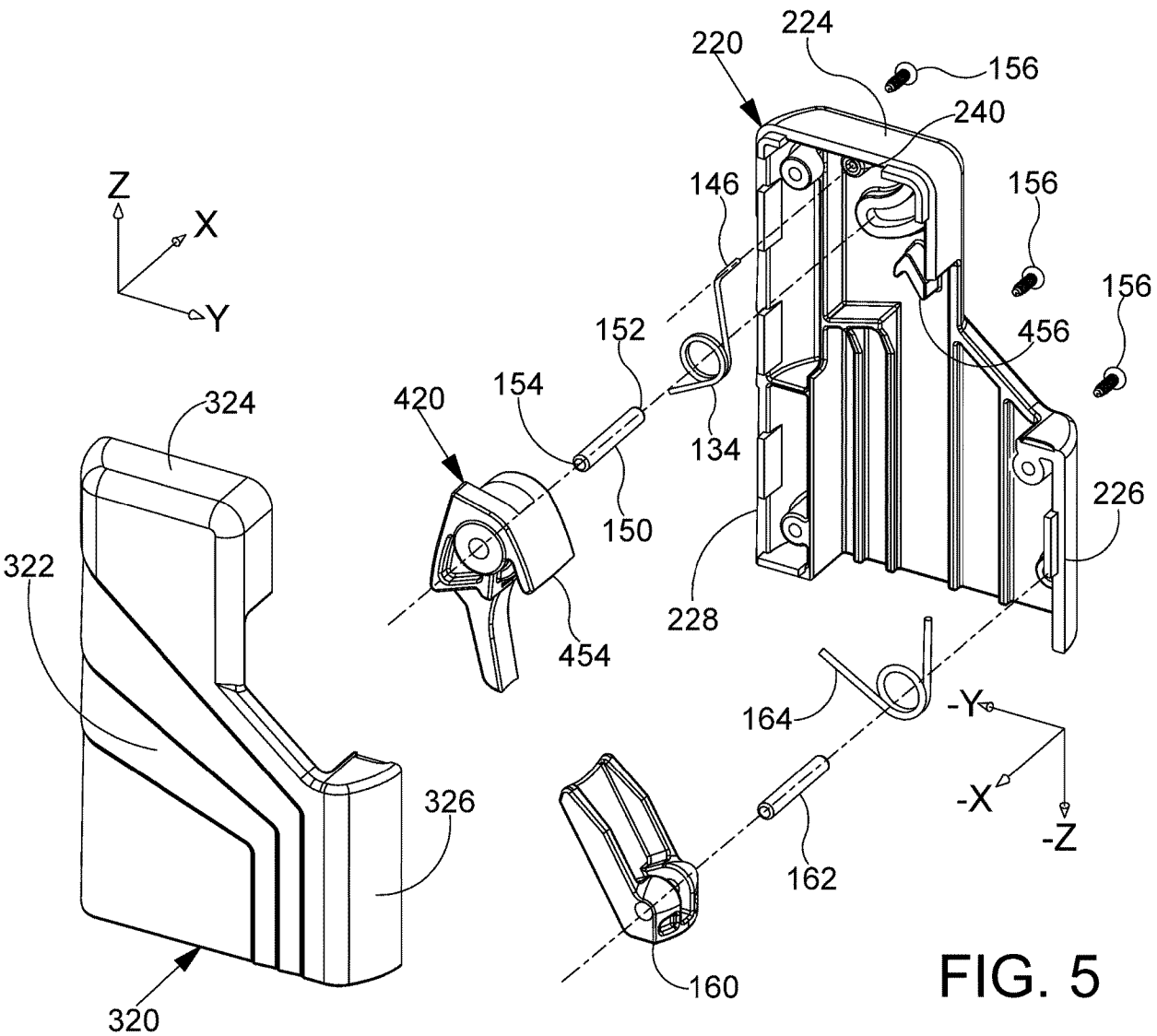
FIG. 5 is an exploded perspective view of a magazine loader in accordance with the detailed description.
Figure 6:
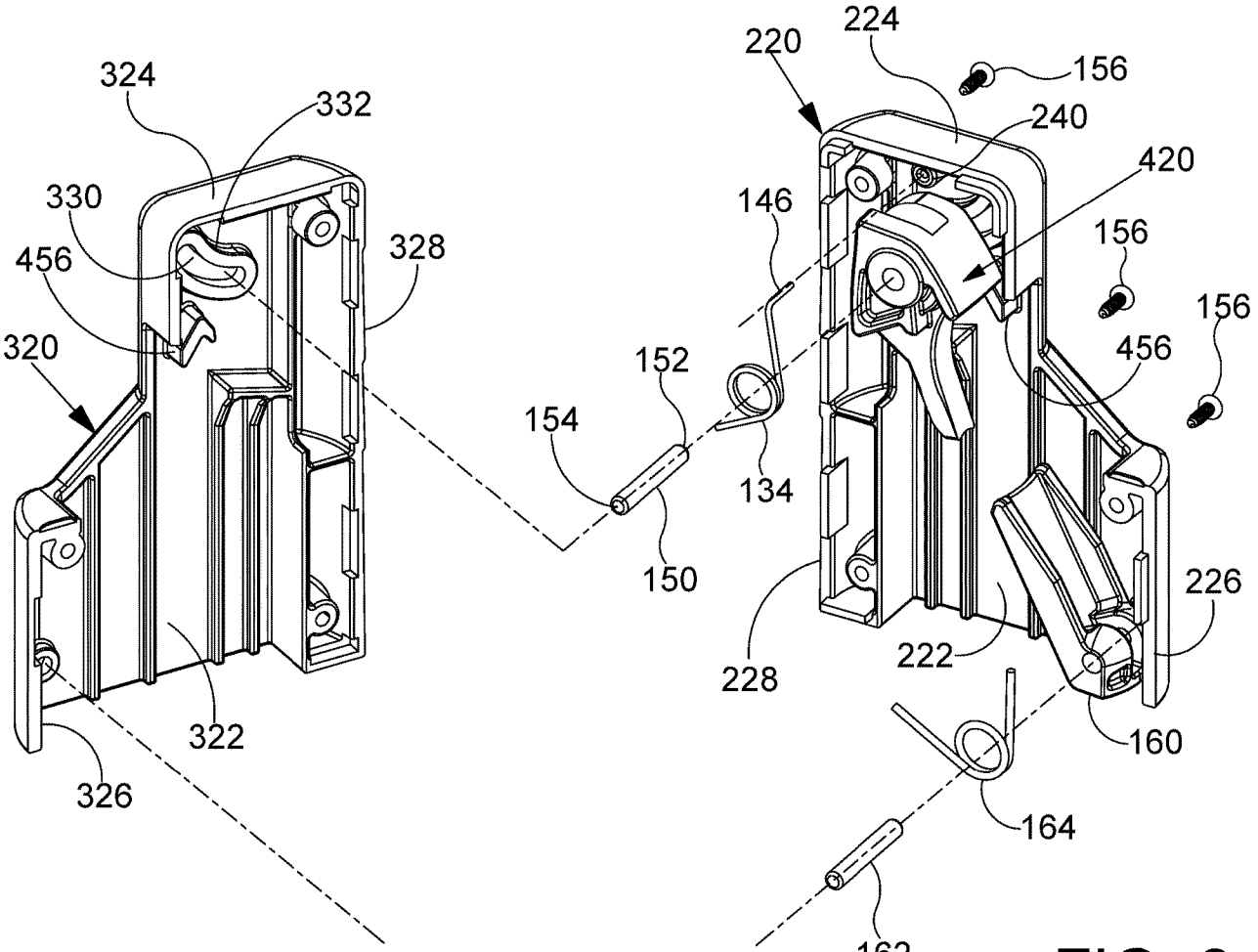
FIG. 6 is a partially exploded perspective view of a magazine loader in accordance with the detailed description.
Figure 7:
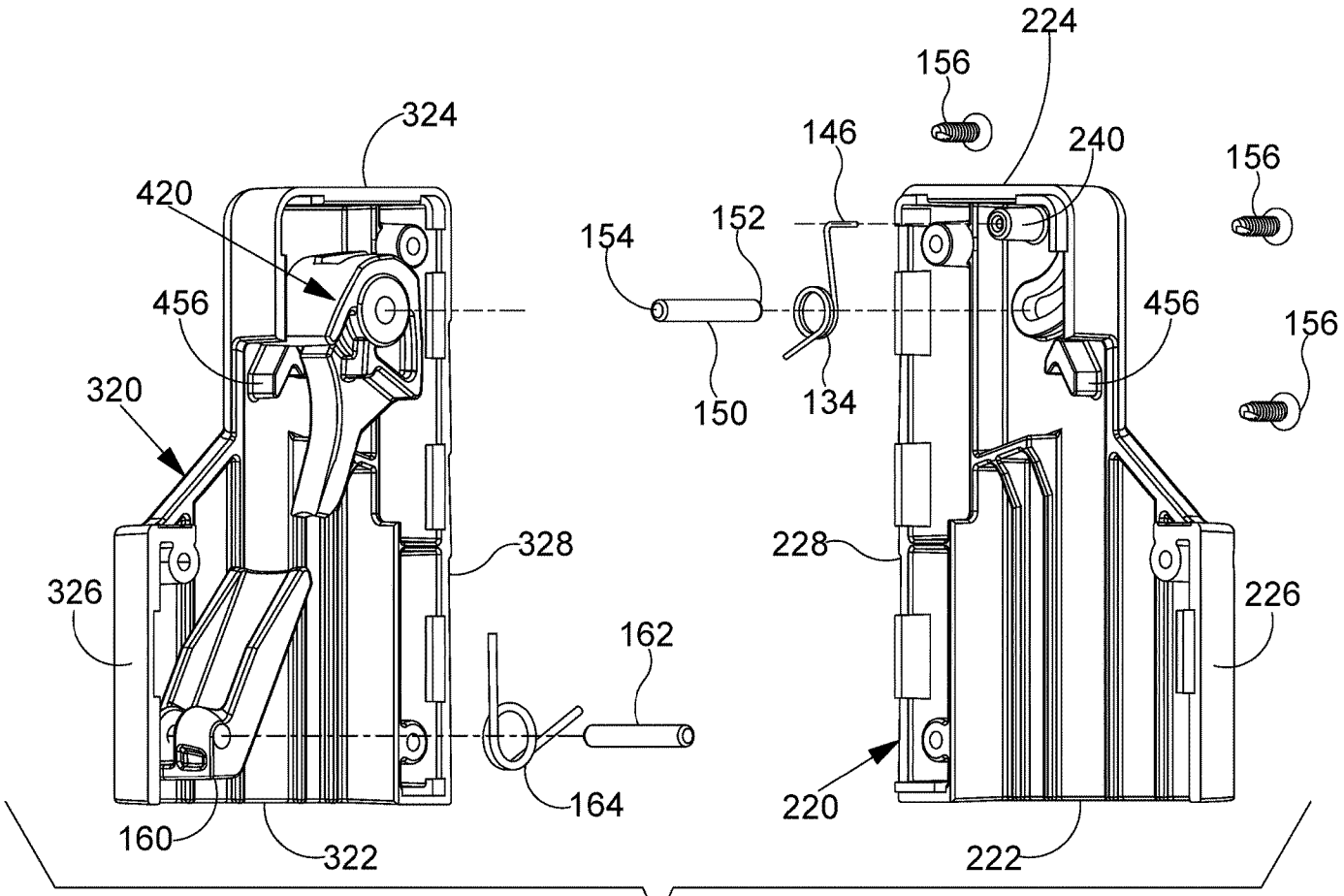
FIG. 7 is a partially exploded perspective view of a magazine loader in accordance with the detailed description.
Figure 8:
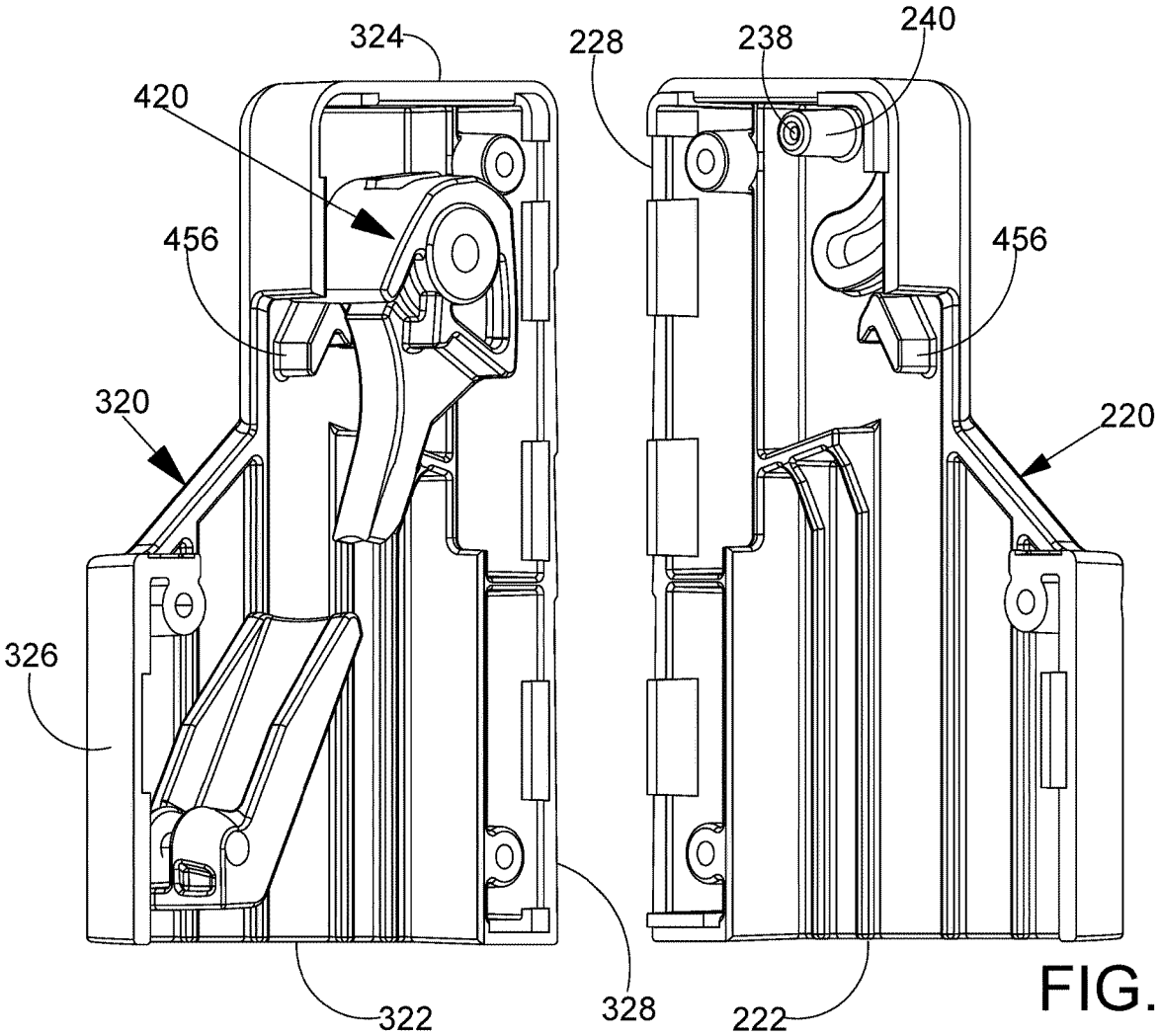
FIG. 8 is an enlarged perspective view further illustrating some of elements of the magazine loader show in FIG. 7.

Referring, for example, to FIGS. 4 and 5, an upward direction Z and a downward or lower direction −Z are illustrated using arrows labeled "Z" and "−Z," respectively. A forward direction Y and a rearward direction −Y are illustrated using arrows labeled "Y" and "−Y," respectively. A starboard direction X and a port direction −X are illustrated using arrows labeled "X" and "−X," respectively. The directions illustrated using these arrows are applicable to the apparatus shown and discussed throughout this application. The port direction may also be referred to as the portward direction. In one or more embodiments, the upward direction is generally opposite the downward direction. In one or more embodiments, the upward direction and the downward direction are both generally orthogonal to an XY plane defined by the forward direction and the starboard direction. In one or more embodiments, the forward direction is generally opposite the rearward direction. In one or more embodiments, the forward direction and the rearward direction are both generally orthogonal to a ZY plane defined by the upward direction and the starboard direction. In one or more embodiments, the starboard direction is generally opposite the port direction. In one or more embodiments, starboard direction and the port direction are both generally orthogonal to a ZX plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

Figure 9C:
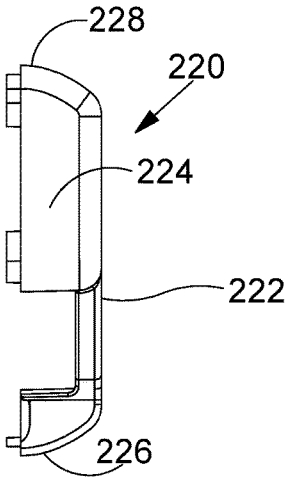
FIG. 9C is a top view of the starboard shell shown in FIG. 9A.
Figure 9A:
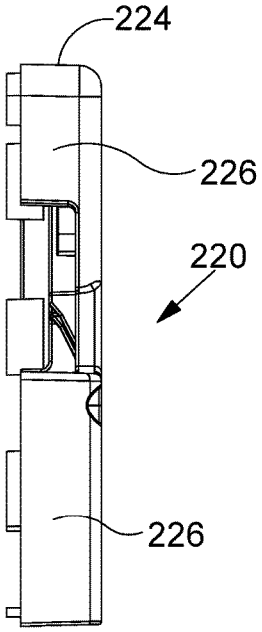
FIG. 9A is a front view of a starboard shell for a magazine loader in accordance with detailed description.
Figure 9B:
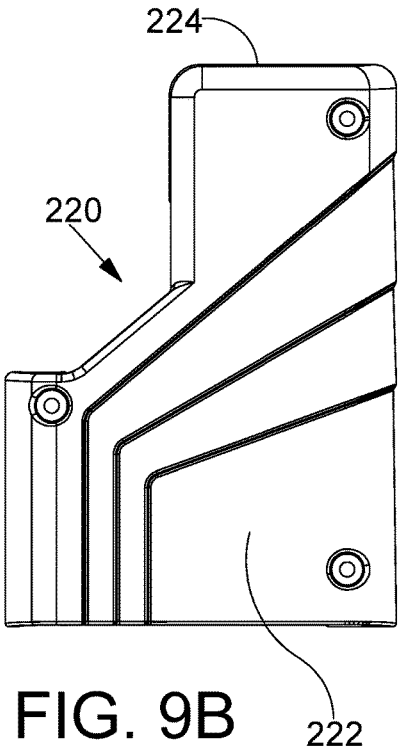
FIG. 9B is a right side view of the starboard shell shown in FIG. 9A.
Figure 9D:
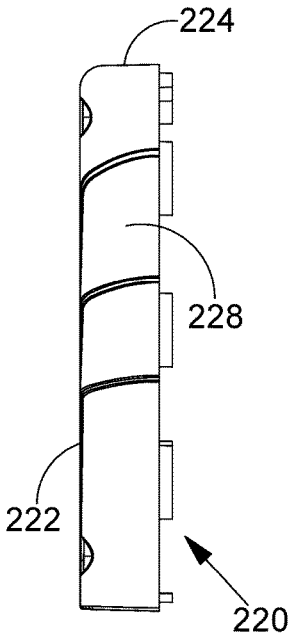
FIG. 9D is a rear view of the starboard shell shown in FIG. 9A.
Figure 9E:
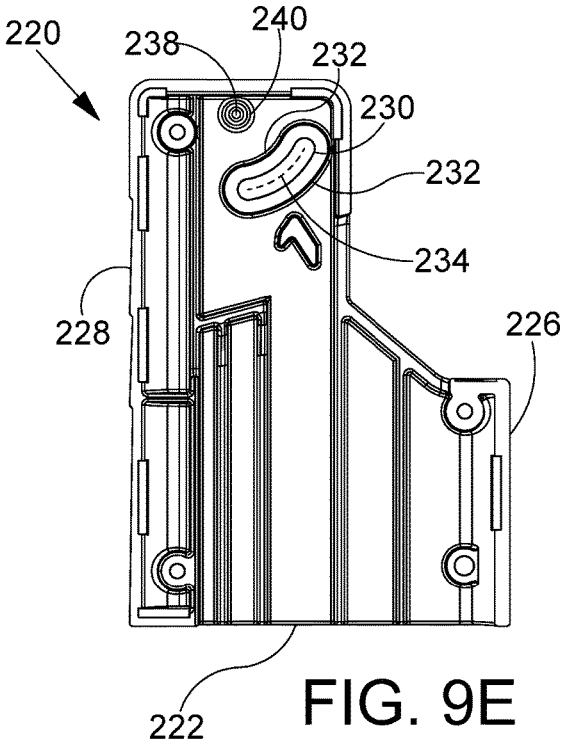
FIG. 9E is a left side view of the starboard shell shown in FIG. 9A.
Figure 9F:
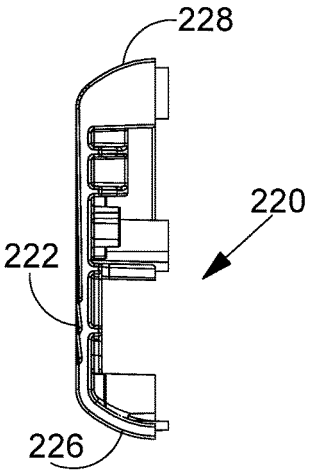
FIG. 9F is a bottom view of the starboard shell shown in FIG. 9A.

FIG. 9A through FIG. 9F are elevation and plan views showing six sides of the starboard shell 220. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 9A may be referred to as a front view of the starboard shell 220, FIG. 9B may be referred to as a right side view of the starboard shell 220, and FIG. 9C may be referred to as a top view of the starboard shell 220. FIG. 9A through FIG. 9F may be referred to collectively as FIG. 9. Terms such as front view and right side view are used herein as a convenient method for differentiating between the views shown in FIG. 9. It will be appreciated that the elements shown in FIG. 9 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 9D may be referred to as a rear view of the starboard shell 220, FIG. 9E may be referred to as a left side view of the starboard shell 220, and FIG. 9F may be referred to as a bottom view of the starboard shell 220.

Figure 10C:
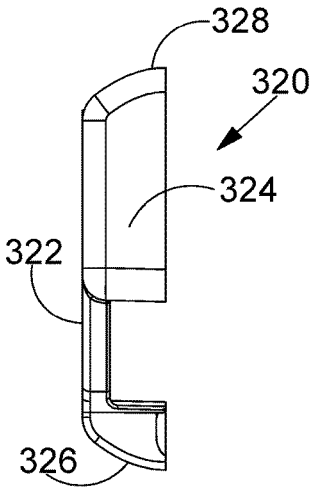
FIG. 10C is a top view of the port shell shown in FIG. 10A.
Figure 10A:
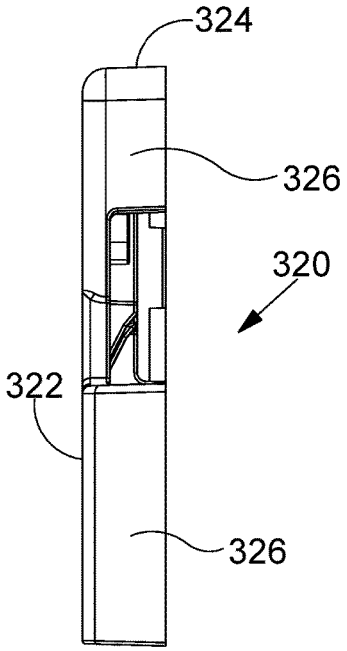
FIG. 10A is a front view of a port shell for a magazine loader in accordance with detailed description.
Figure 10B:
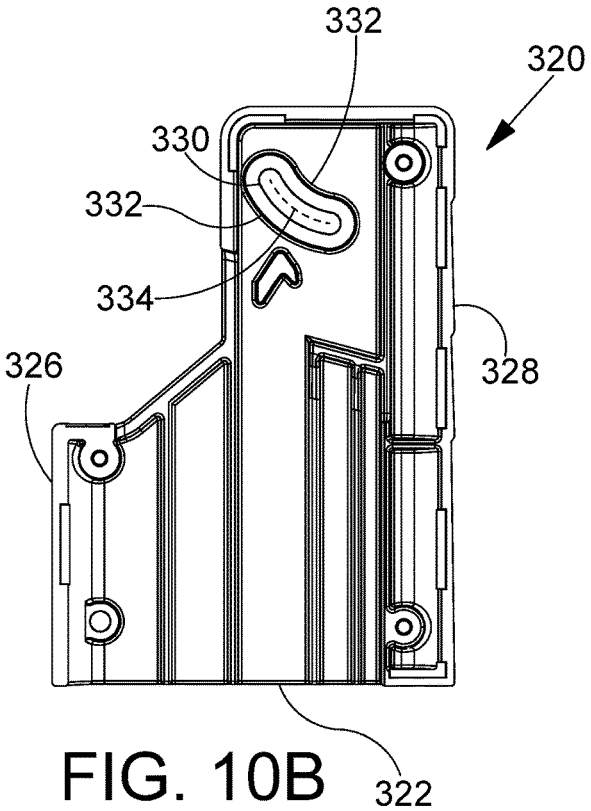
FIG. 10B is a right side view of the port shell shown in FIG. 10A.
Figure 10D:
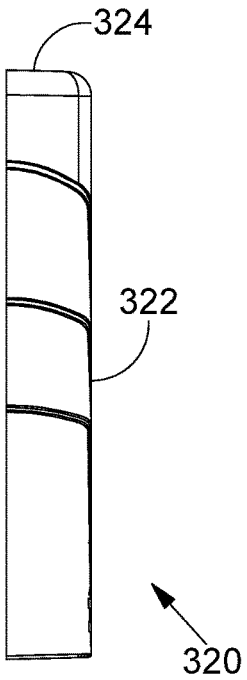
FIG. 10D is a rear view of the port shell shown in FIG. 10A.
Figure 10E:
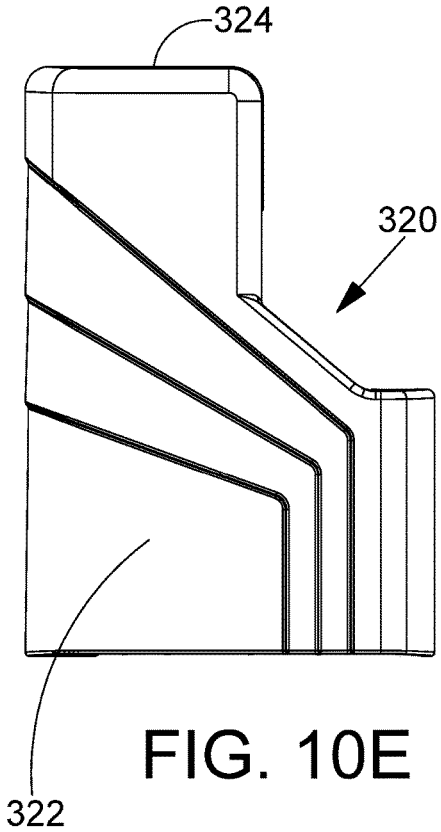
FIG. 10E is a left side view of the port shell shown in FIG. 10A.
Figure 10F:
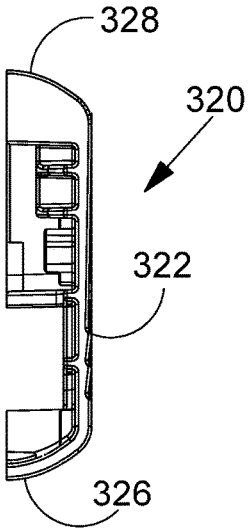
FIG. 10F is a bottom view of the port shell shown in FIG. 10A.

Referring to FIG. 10A through FIG. 10F, views showing six sides of the port shell 320. In the field of engineer graphics, the process used to create views showing six sides of a three dimensional object may be referred to as multiview projection or orthographic projection. It is also customary to refer to multiview or orthographic projection using terms such as front view, right side view, top view, rear view, left side view, and bottom view. In accordance with this convention, FIG. 10A may be referred to as a front view of the port shell 320, FIG. 10B may be referred to as a right side view of the port shell 320, and FIG. 10C may be referred to as a top view of the port shell 320. FIG. 10A through FIG. 10F may be referred to collectively as FIG. 10. Terms such as front view and right side view are used herein as a convenient method for differentiating between the views shown in FIG. 10. It will be appreciated that the elements shown in FIG. 10 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 10D may be referred to as a rear view of the port shell 320, FIG. 10E may be referred to as a left side view of the port shell 320, and FIG. 10F may be referred to as a bottom view of the port shell 320.

Figure 11C:
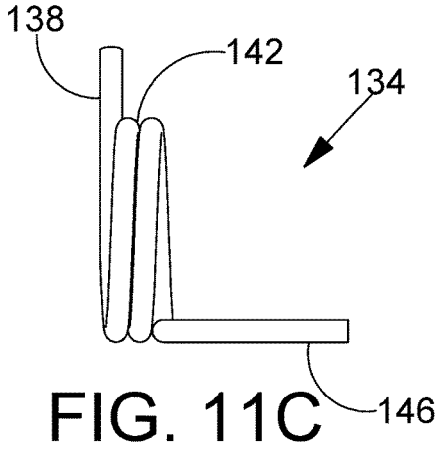
FIG. 11C is a top view of the spring shown in FIG. 11A.
Figure 11A:
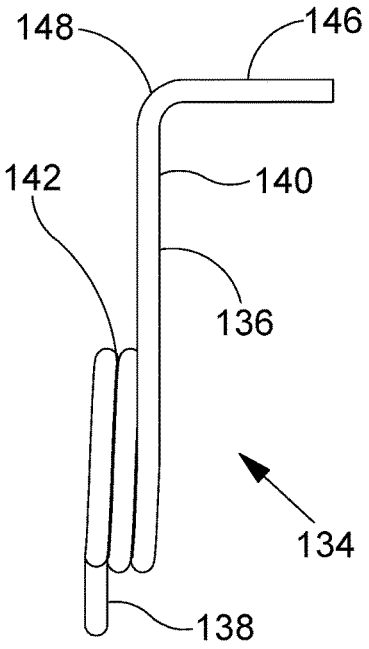
FIG. 11A is a front view of a spring for a magazine loader in accordance with detailed description.
Figure 11B:
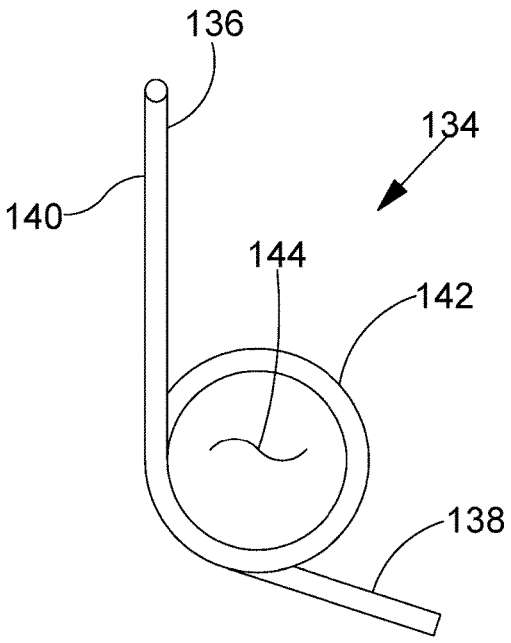
FIG. 11B is a right side view of the spring shown in FIG. 11A.
Figure 11D:
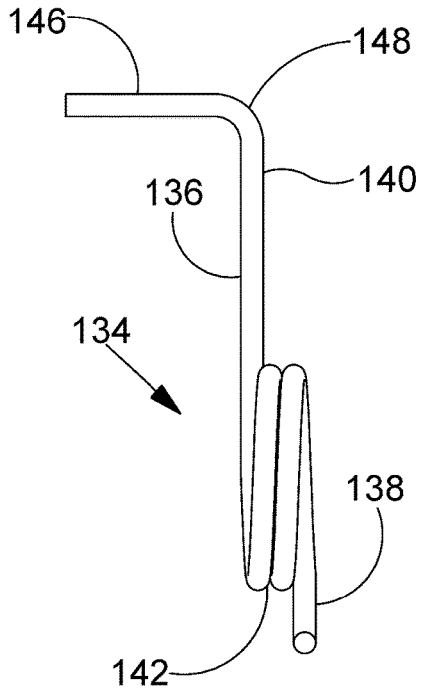
FIG. 11D is a rear view of the spring shown in FIG. 11A.
Figure 11E:
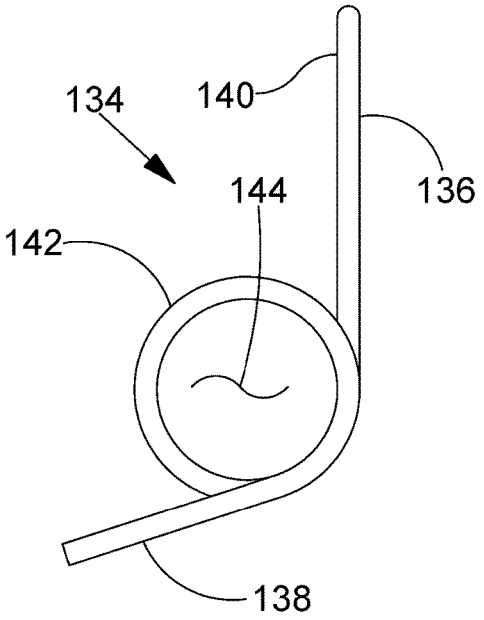
FIG. 11E is a left side view of the spring shown in FIG. 11A.
Figure 11F:
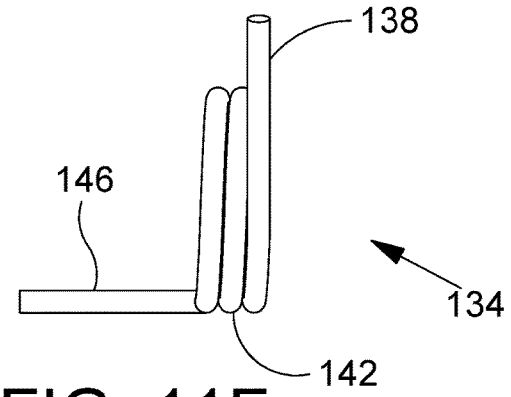
FIG. 11F is a bottom view of the spring shown in FIG. 11A.

FIG. 11A through FIG. 11F are elevation and plan views showing six sides of the spring 134. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 11A may be referred to as a front view of the spring 134, FIG. 11B may be referred to as a right side view of the spring 134, and FIG. 11C may be referred to as a top view of the spring 134. FIG. 11A through FIG. 11F may be referred to collectively as FIG. 11. Terms such as front view and right side view are used herein as a convenient method for differentiating between the views shown in FIG. 11. It will be appreciated that the elements shown in FIG. 11 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 11D may be referred to as a rear view of the spring 134, FIG. 11E may be referred to as a left side view of the spring 134, and FIG. 11F may be referred to as a bottom view of the spring 134.

Figure 12C:
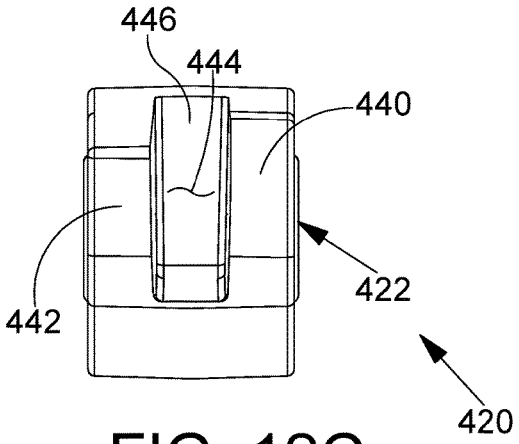
FIG. 12C is a top view of the tool shown in FIG. 12A.
Figure 12A:
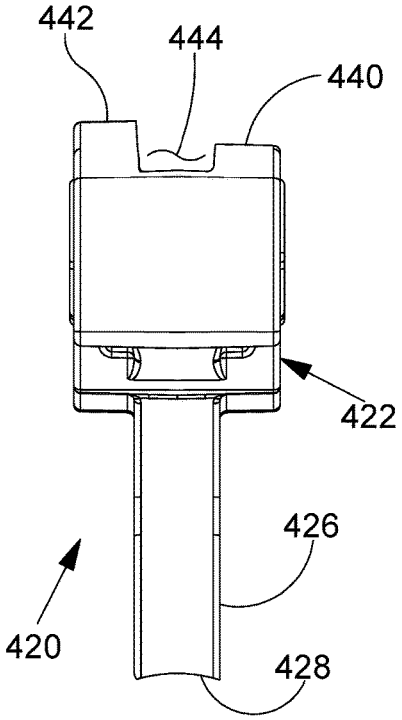
FIG. 12A is a front view of a tool for a magazine loader in accordance with detailed description.
Figure 12B:
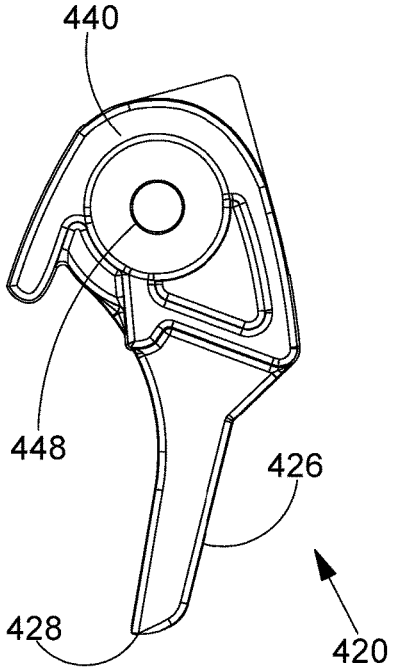
FIG. 12B is a right side view of the tool shown in FIG. 12A.
Figure 12D:
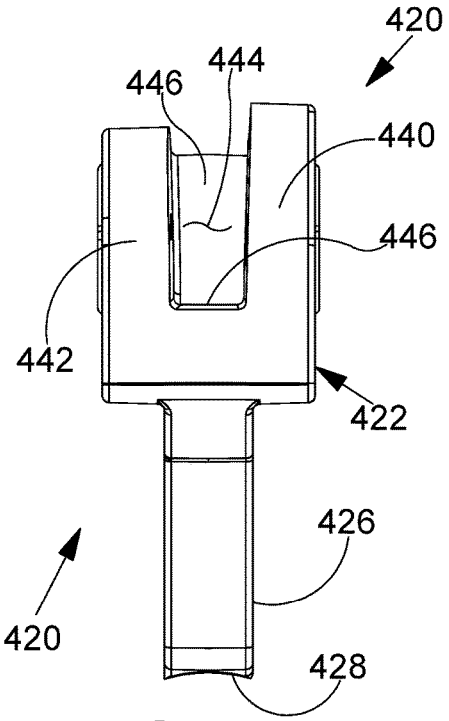
FIG. 12D is a rear view of the tool shown in FIG. 12A.
Figure 12E:
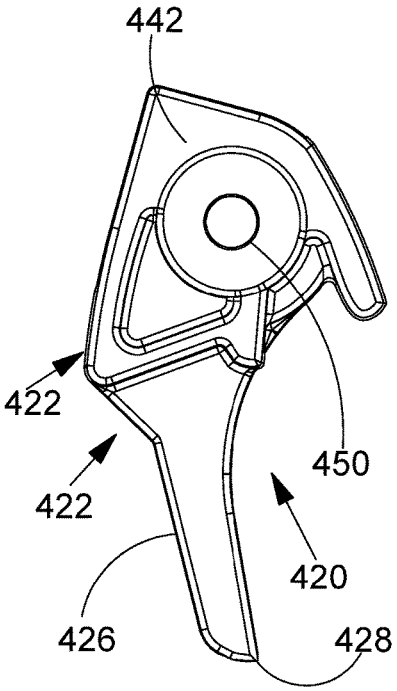
FIG. 12E is a left side view of the tool shown in FIG. 12A.
Figure 12F:
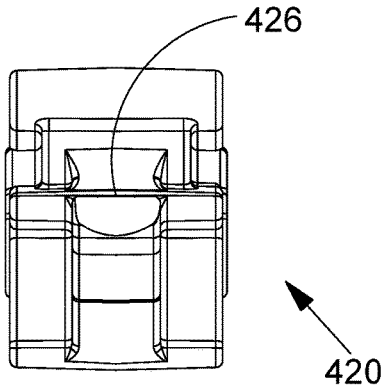
FIG. 12F is a bottom view of the tool shown in FIG. 12A.
Figure 13C:
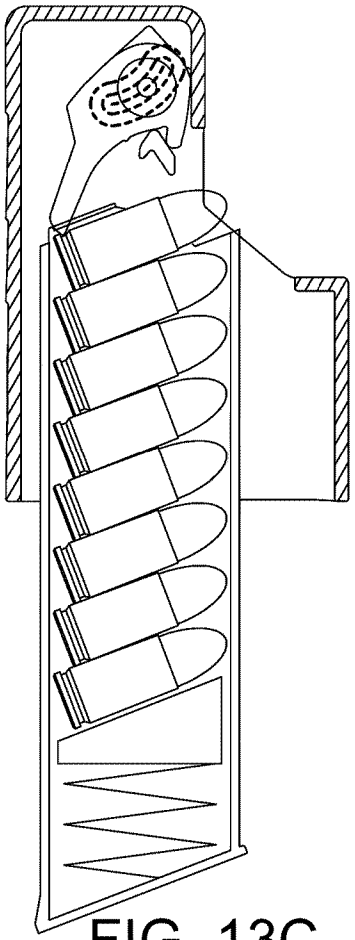
FIG. 13A, FIG. 13B and FIG. 13C are a sequence of stylized section views illustrating the operation of a magazine loader in accordance with the detailed description. In the embodiment of FIGS. 13A and 13B, the tool of the magazine loader is disposed in a starting position. In the embodiment of FIG. 13C, the tool of the magazine loader is disposed in an ending position.
Figure 13B:
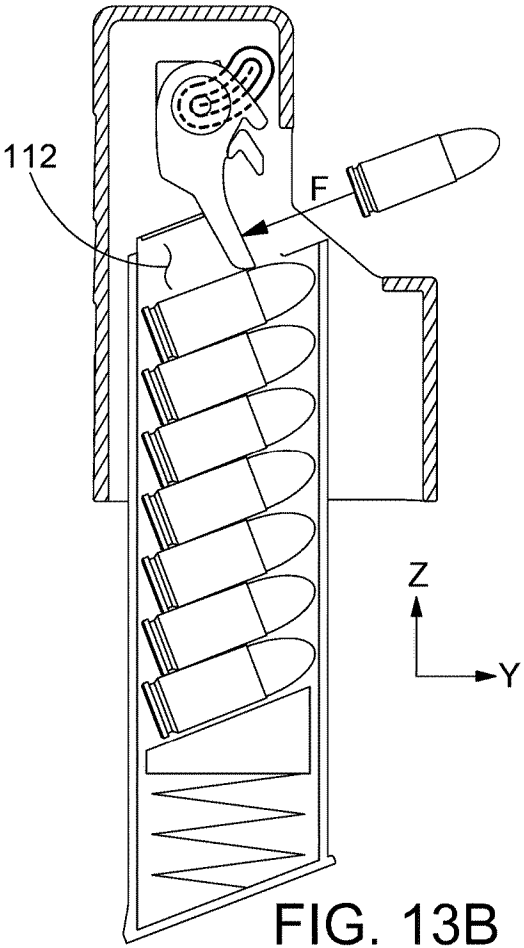
Figure 13A:
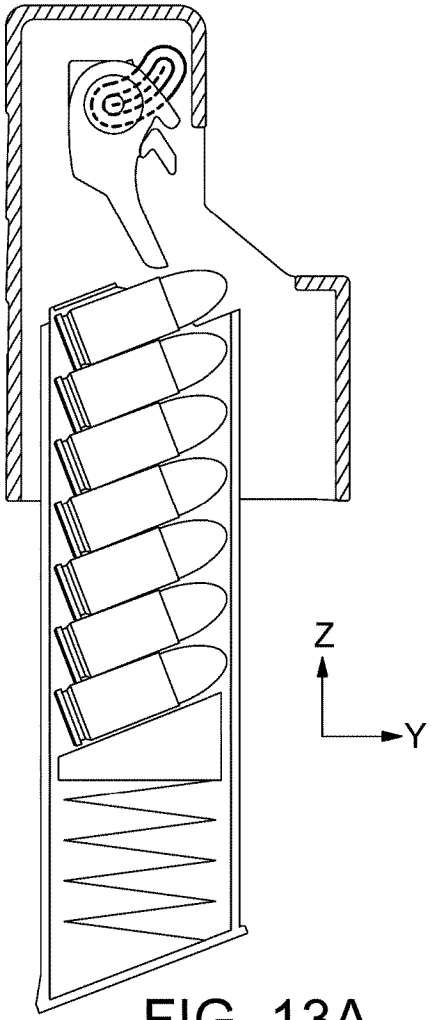

Referring to FIG. 12A through FIG. 12F, views showing six sides of the tool 420. In the field of engineer graphics, the process used to create views showing six sides of a three dimensional object may be referred to as multiview projection or orthographic projection. It is also customary to refer to multiview or orthographic projection using terms such as front view, right side view, top view, rear view, left side view, and bottom view. In accordance with this convention, FIG. 12A may be referred to as a front view of the tool 420, FIG. 12B may be referred to as a right side view of the tool 420, and FIG. 12C may be referred to as a top view of the tool 420. FIG. 12A through FIG. 12F may be referred to collectively as FIG. 12. Terms such as front view and right side view are used herein as a convenient method for differentiating between the views shown in FIG. 12. It will be appreciated that the elements shown in FIG. 12 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 12D may be referred to as a rear view of the tool 420, FIG. 12E may be referred to as a left side view of the tool 420, and FIG. 12F may be referred to as a bottom view of the tool 420.

Figure 14B:
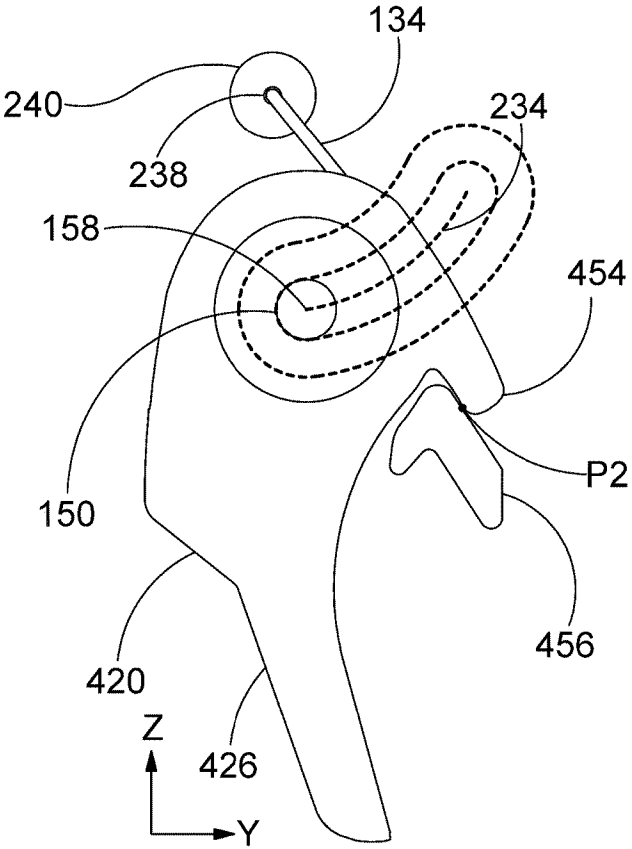
FIG. 14A and FIG. 14B are stylized diagrams illustrating a tool and a first motion that may be experience by the tool when a rearwardly directed force applied to the tool. The tool moves from the position shown in FIG. 14A to the position shown in FIG. 14B with the first motion.
Figure 14A:
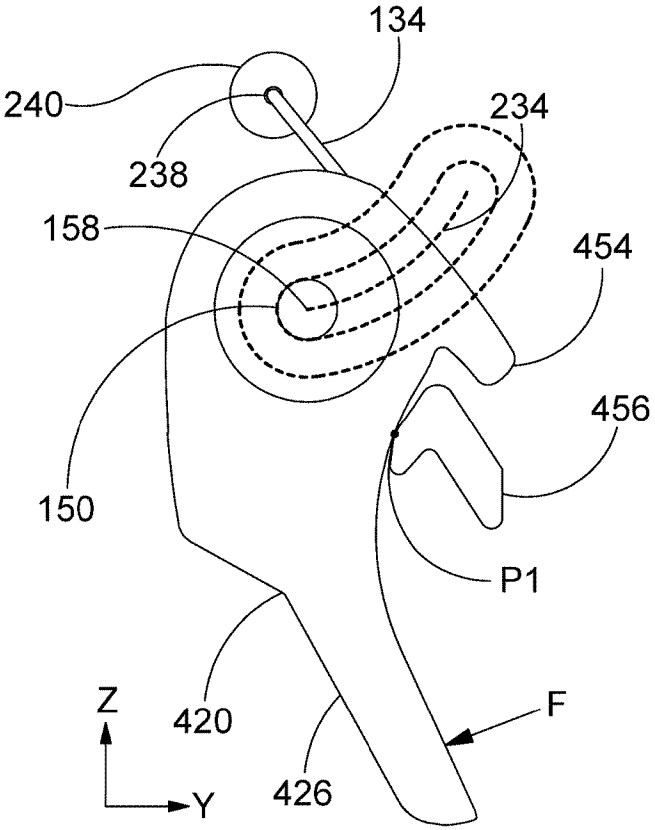

FIG. 14A and FIG. 14B are stylized diagrams illustrating a tool 420 and a first motion that may be experience by the tool 420 when a rearwardly directed force F is applied to the tool. The tool 420 moves from the position shown in FIG. 14A to the position shown in FIG. 14B with the first motion. In the embodiment of FIG. 14A, the tool 420 is biased to rotate by a spring 164, 206 so that the first arm 426 of the tool 420 contacts a protrusion 456 at a first point of contact P1. In the embodiment of FIG. 14A, the rearwardly directed force F has been applied to tool so that the tool has rotated about the pin 150 until the second arm 454 of the tool 420 has contacted the protrusion 456 at a second point of contact P2.

Figure 15B:
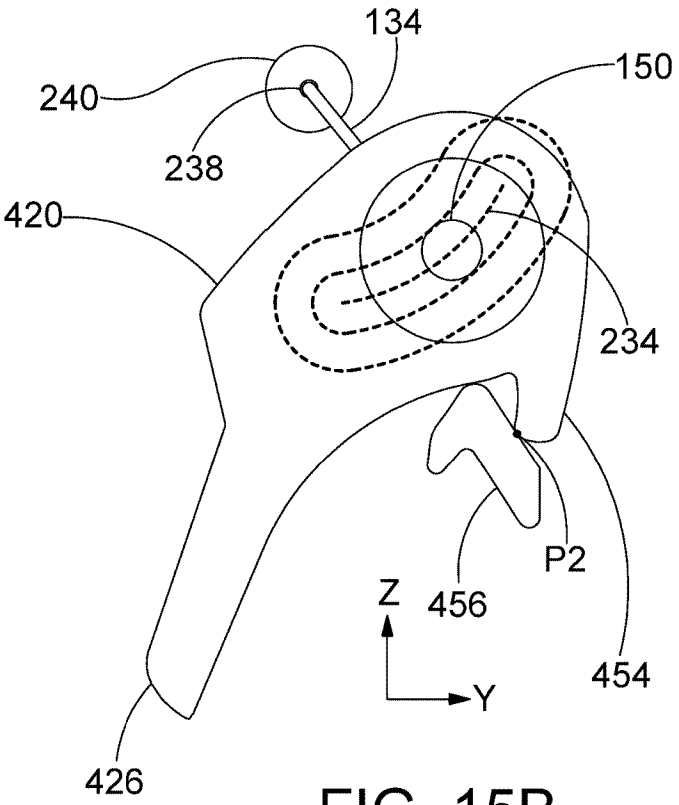
FIG. 15A and FIG. 15B are stylized diagrams illustrating a tool and a second motion that may be experience by the tool after the first motion illustrated in the previous figure. The tool moves from the position shown in FIG. 15A to the position shown in FIG. 15B with the second motion.
Figure 15A:
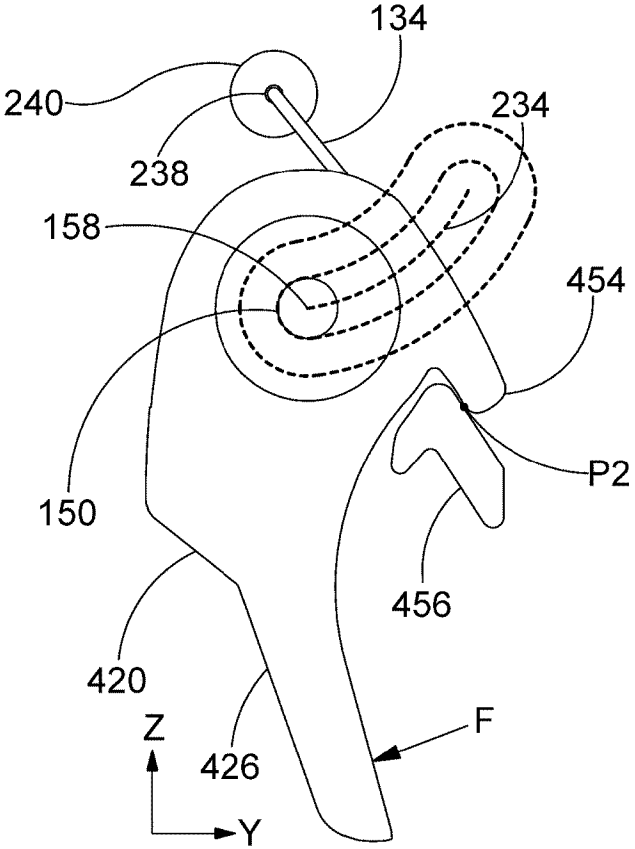
Figure 16:
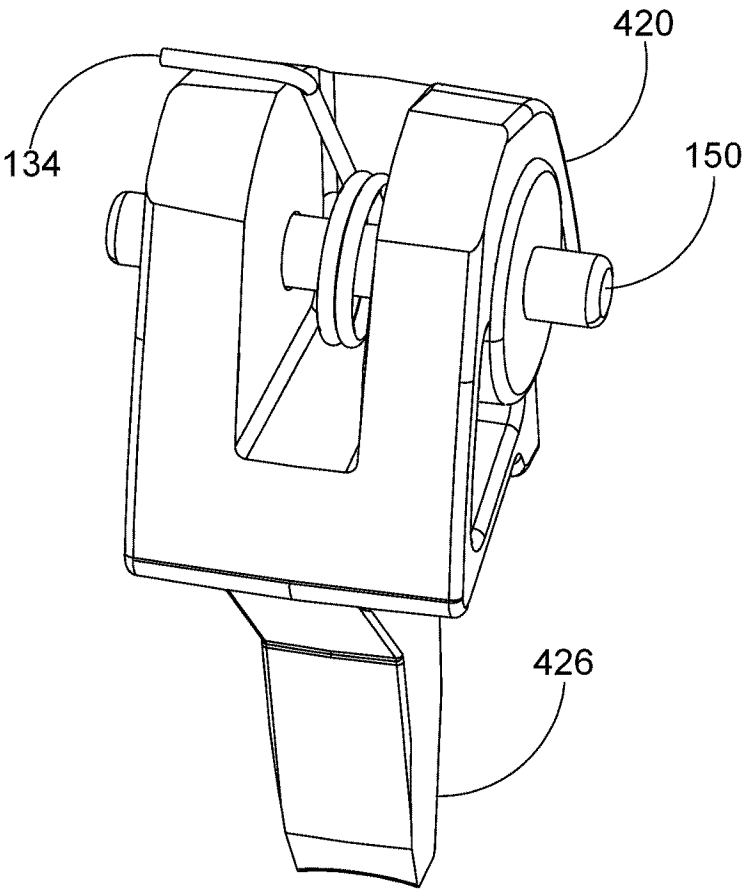
FIG. 16 is a perspective view showing the assembly including a tool, a spring, and a pin.
Figure 17:
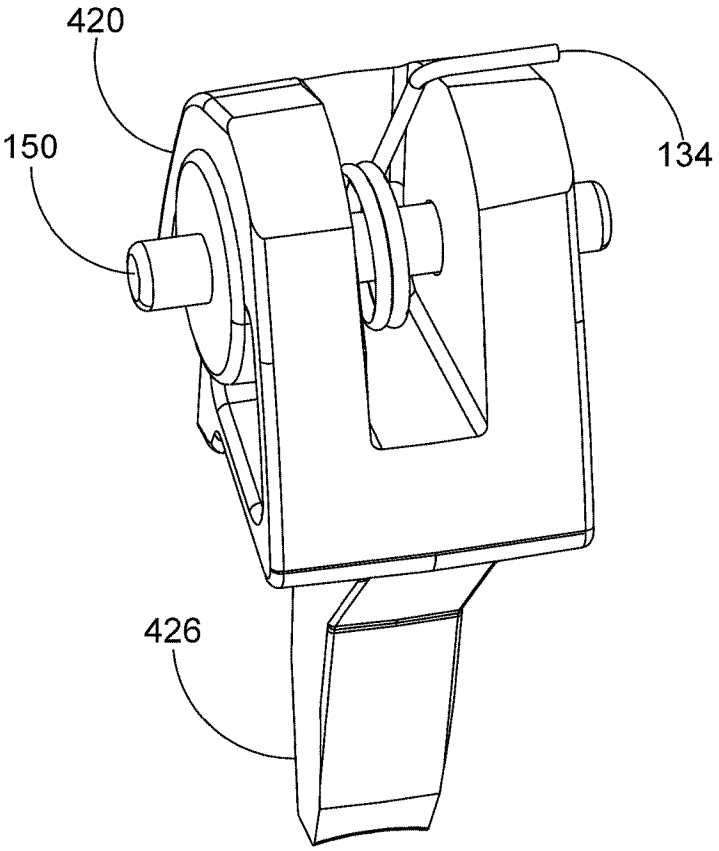
FIG. 17 is a perspective view showing an additional embodiment of an assembly including a tool, a spring, and a pin.
Figures 18A, 18B:
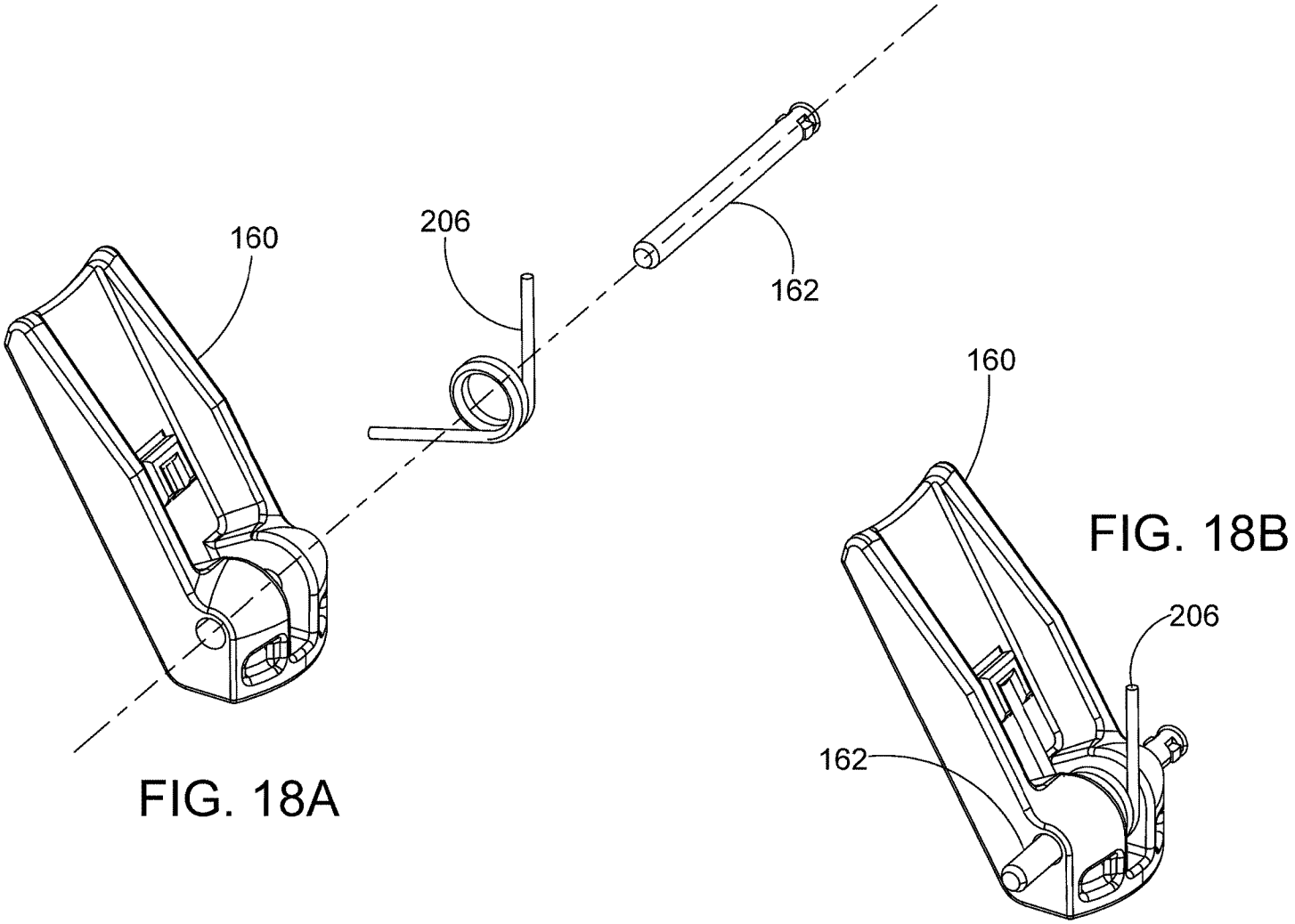
FIG. 18A is an exploded perspective view of an assembly including a lever, a spring and an axle.
FIG. 18B is a perspective view showing the assembly of FIG. 18A in an assembled state.
Figure 19:
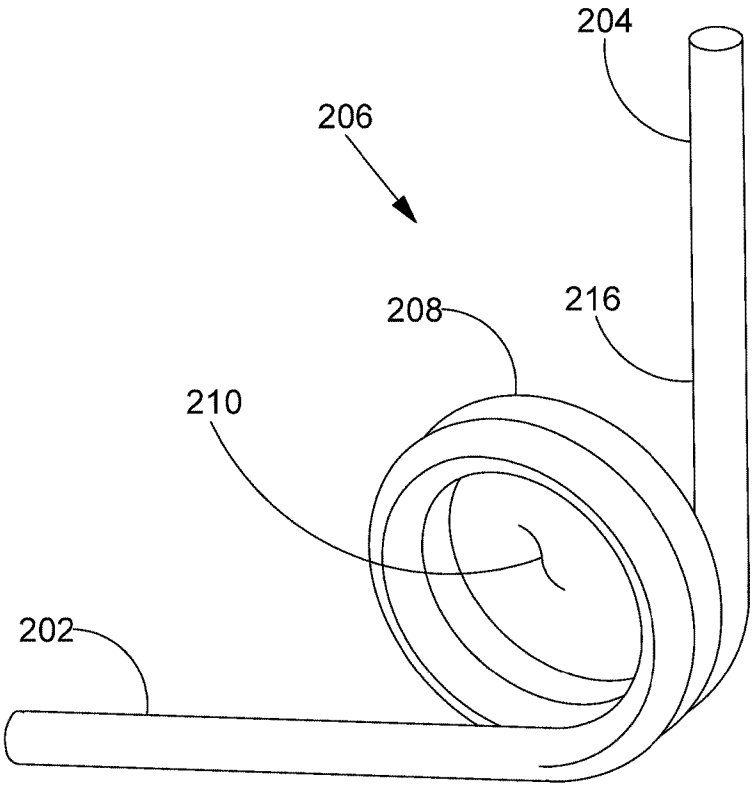
FIG. 19 is a perspective view further illustrating the spring shown in FIGS. 18A and18B.
Figure 20:
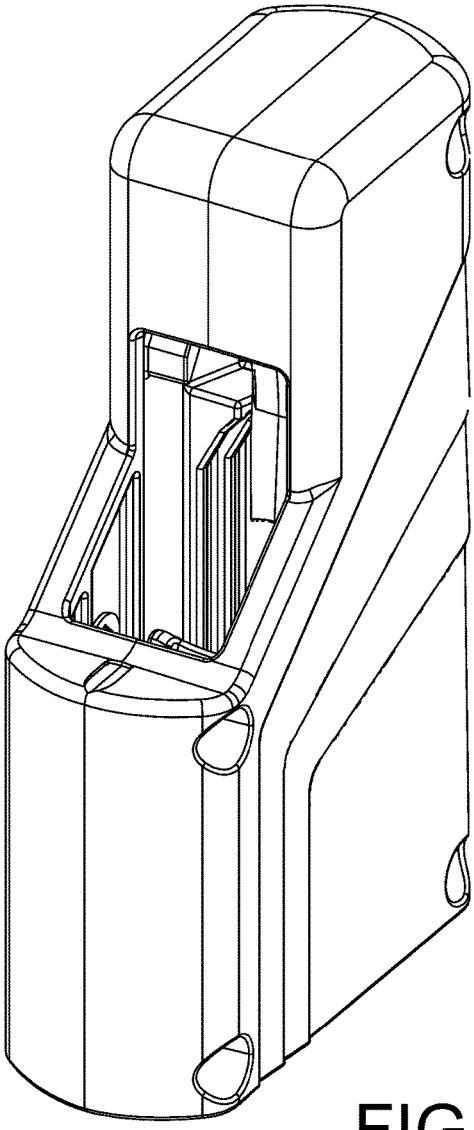
FIG. 20 is a front, right, top perspective view of a magazine loader.
Figure 21:
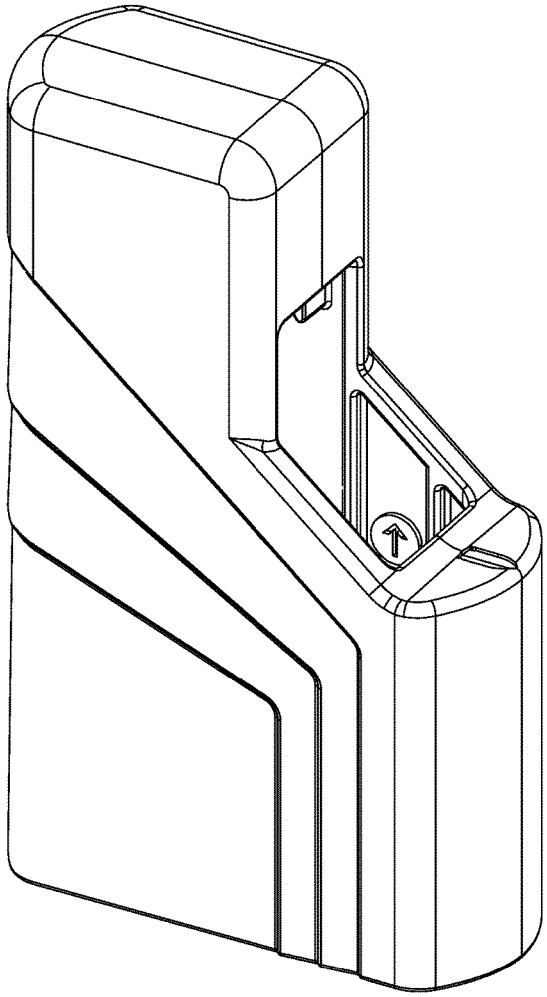
FIG. 21 is a front, left, top perspective view of a magazine loader.
Figure 22:
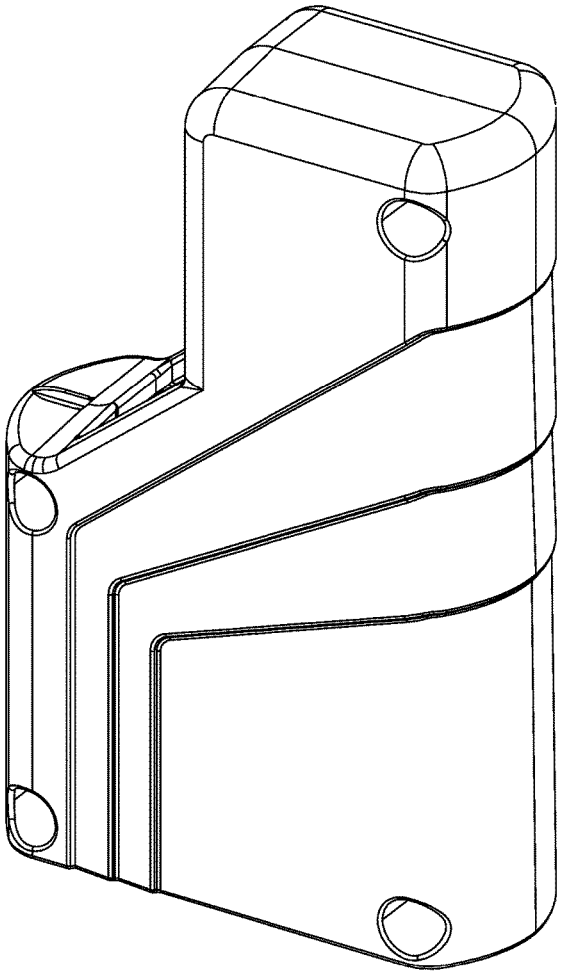
FIG. 22 is a rear, right, top perspective view of a magazine loader.
Figure 23:
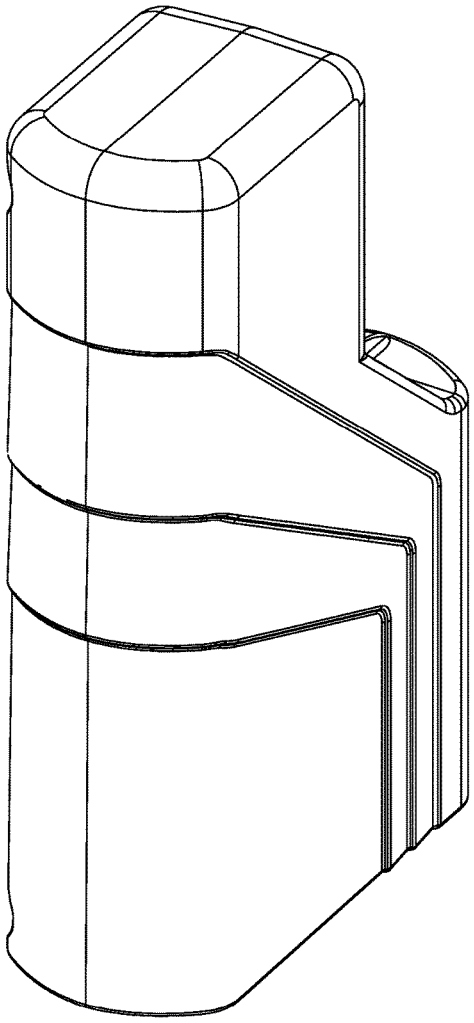
FIG. 23 is a rear, left, top perspective view of a magazine loader.

FIG. 15A and FIG. 15B are stylized diagrams illustrating a tool 420 and a second motion that may be experience by the tool 420 after the first motion illustrated in the previous figure. The tool 420 moves from the position shown in FIG. 15A to the position shown in FIG. 15B with the second motion. In the embodiment of FIG. 15A, the tool 420 is shown in the position reached after the first motion of the tool 420. In the embodiment of FIG. 15B, additional rearwardly directed force F has been applied to tool so that the tool has rotated about the second point of contact P2 and the pin 150 has moved forwardly and upwardly along the path 434. In some useful embodiments, the forward and upward movement of the pin 150 along the path acts to withdraw the first arm 426 of the tool from the uppermost cartridge position of a magazine. This allows a cartridge to occupy the uppermost cartridge position of the magazine.

Referring, for example, to FIGS. 5-7 and 18-19, in one or more embodiments, a magazine loader 100 comprises a lever 160 that pivots about an axle 162. In an embodiment, the lever 160 is biased to rotate toward a first orientation by an elastic member 164 and, by compression of the elastic member 164, the lever 160 can be urged to rotate toward a second orientation different from the first orientation. When the magazine loader 100 is in an assembled state, the starboard end of the axle 162 is supported by the starboard shell 220 and the port end of the axle 162 is supported by the port shell 320. The starboard shell 220 and the port shell 320 may be fastened to one another using a plurality of screws 156.

Referring, for example, to FIGS. 5-7 and 18-19, the magazine loader 100 may include a lever 160 disposed inside the housing cavity 124 defined by the housing 120 for urging the magazine against the front wall portion of the housing 120. The lever 160 may be pivotally supported by an axle 162. In some embodiments, the axle 162 extends through a first opening defined by a starboard housing wall portion 222 of the housing 120 and a second opening defined by a port housing wall portion 322 of the housing 120. The spring 206 may comprise a length of wire 216. The wire 216 of the spring 206 may form a first leg 202, a second leg 204 and a coil 208 disposed between the first leg 202 and the second leg 204. The coil 208 defines a lumen 210 in some embodiments. In some embodiments, the first leg 202 of the spring 206 is seated against the lever 160 and the second leg 204 of the spring 206 is seated against the housing 120. The axle 162 extends through the lumen 210 defined by the coil 208 disposed between the first leg 202 and the second leg 204 in some embodiments.

Referring, for example, to FIGS. 4-7 and 13-15, a magazine loader 100 for sequentially loading cartridges into an uppermost cartridge position of a magazine 20 comprises a housing 120 having a housing cavity 124, an upper and forward opening for insertion of individual cartridges and a bottom opening 122 for insertion of the magazine 20. The housing cavity 124 may be configured to receive an upper portion of the magazine 20. The housing cavity 124 may extend along a magazine insertion and withdrawal axis MA. In an embodiment, the magazine loader 100 includes a tool 420 rotatable mounted at the upper opening. In an embodiment, the tool 420 has a first arm 426 extending away from the bore 448, 450 defined by the tool 420 toward the housing cavity and positioned to be in an interference position with the magazine 20 when the magazine 20 is inserted. In an embodiment, the first arm 426 is deflectable rearwardly rotating the tool 420. In an embodiment, the tool 420 is mounted to the housing 120 such that the tool 420 rotates and translates with respect to the housing 120. In an embodiment, the tool 420 is mounted by way of a pin 150 extending through the tool 420 to a pair of opposing slots or channels defined in opposing wall portions of the housing 120. In an embodiment, each slot or channel has a generally arcuate shape. In an embodiment, the tool 420 is biased such that the first arm 426 is urged forwardly. In an embodiment, the tool 420 has an engagement portion or second arm 454 that engages a second cooperating engagement surface on the housing 120, whereby when the first arm 426 is pushed rearwardly the engagement portion or second arm 454 engages the second cooperating engagement portion on the housing 120 thereby urging the pin 150 to follow the slots or channels. In an embodiment, the magazine loader 100 includes a spring loaded lever to urge the magazine 20 rearwardly in the housing 120.

The following United States patents are hereby incorporated by reference herein: U.S. Pat. No. 4,464,855, U.S. Pat. No. 4,689,909, U.S. Pat. No. 4,719,715, U.S. Pat. No. 4,827,651, U.S. Pat. No. 4,829,693, U.S. Pat. No. 4,888,902, U.S. Pat. No. 4,993,180, U.S. Pat. No. 5,249,386, U.S. Pat. No. 5,355,606, U.S. Pat. No. 5,377,436, U.S. Pat. No. 6,178,683, U.S. Pat. No. 6,817,134, U.S. Pat. No. 7,257,919, U.S. Pat. No. 7,383,657, U.S. 7,503,138, U.S. Pat. No. 7,637,048, U.S. Pat. No. 7,805,874, U.S. Pat No. 9,212,859, and U.S. Pat. No. 9,347,722.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention. The inventors of the magazine loaders described herein are associated with Fred Sparks Design of St. Louis, Mo.

What is claimed is:

1. An apparatus for sequentially loading cartridges into an uppermost cartridge space of a magazine, comprising:

a housing having a top end and a bottom end, the housing comprising a plurality of wall portions defining a housing cavity with an upper loading opening proximate the top end and a lower opening proximate the bottom end, the housing cavity configured to receive an upper portion of the magazine, the housing cavity extending along a magazine insertion and withdrawal axis, the plurality of wall portions comprising a starboard wall portion and an opposing port wall portion, the wall portions defining opposing pin receiving channels;

a tool disposed between the starboard wall portion and the port wall portion, the tool comprising a central portion defining a bore, a first arm extending away from the bore and a second arm displaced forwardly from the first arm;

a pin having a starboard end, a port end and an intermediate portion extending between the starboard end and the port end, the starboard end of the pin being disposed inside a starboard channel and the port end of the pin being disposed inside a port channel so that translation of the pin is constrained to movement along a path defined by the channels, and the intermediate portion of the pin extending through the bore defined by the central portion of the tool so that the tool is supported by the pin and the pin follows the path defined by the channels;

when a cartridge is inserted through the upper loading opening, the cartridge effects a rearwardly directed force to the first arm of the tool causing the tool to rotate about a pin axis until the second arm of the tool contacts a protrusion of the housing and further application of the rearwardly directed force to the first arm causes the pin to move forwardly and upwardly along the path thereby withdrawing the first arm from the uppermost cartridge space allowing the cartridge to occupy the uppermost cartridge space.

2. The apparatus of claim 1 further including a spring comprising a length of wire, the wire of the spring forming a first leg, a second leg and a coil disposed between the first leg and the second leg, the coil being disposed between the starboard flange and the port flange, the coil defining a lumen.

3. The apparatus of claim 2 wherein the spring applies a force between the housing and the tool so that the tool is biased to move in a generally rearward direction along the path defined by the channels.

4. The apparatus of claim 3 wherein the spring applies a moment between the housing and the tool so that the tool is biased to rotate about the pin so that a distal end of the arm swings forward.

5. The apparatus of claim 4 wherein the tool comprises a starboard flange and a port flange, the starboard flange and the port flange being disposed on opposite sides of a notch, the notch being defined by an inner surface of the starboard flange, and an inner surface of the port flange, and a central surface of the central portion, the central surface extending between the inner surface of the starboard flange and the inner surface of the port flange, the starboard flange defining a starboard bore disposed on a starboard side of the notch, the starboard bore fluidly communicating with the notch, the port flange defining a port bore disposed on a port side of the notch, the port bore fluidly communicating with the notch.

6. The apparatus of claim 5 wherein the wire of the spring forms a foot extending in an outward direction from the second leg and a bend disposed between the second leg and the foot, the bend being configured so that the foot of the spring extends in the outward direction.

7. The apparatus of claim 6 wherein the foot of the spring extends into a socket defined by a boss, the boss being supported by one of the starboard wall portion or the port wall portion, the boss extending away from the wall portion in an inward direction, the first leg of the spring seating against the central surface of the tool.

8. The apparatus of claim 7 wherein the starboard wall portion comprising one or more inwardly extending starboard ribs, the one or more starboard ribs defining the starboard channel.

9. The apparatus of claim 7 wherein the port wall portion comprising one or more inwardly extending port ribs, the one or more port ribs defining the port channel.

10. The apparatus of claim 1 further comprising a spring loaded lever that urges the magazine rearwardly in the housing.

11. The apparatus of claim 1 further comprising a lever disposed inside the cavity defined by the housing for urging the magazine against a front housing wall portion, the lever being pivotally supported by an axle, the axle extending into a first hole defined by the starboard wall portion and a second hole defined by the port wall portion, the spring comprising a length of wire, the wire of the spring forming a first leg, a second leg and a coil disposed between the first leg and the second leg, the coil defining a lumen, the first leg of the spring being seated against the lever and the second leg of the spring being seated against the housing, the axle extending through the lumen disposed between the first leg and the second leg.

12. A method for sequentially loading cartridges into an uppermost cartridge space of a magazine, comprising:

providing the apparatus of claim 1;

inserting an upper portion of the magazine into the housing cavity;

urging the housing to translate downwardly to depress a follower spring of the magazine;

inserting one end of a cartridge through an opening defined by the housing;

urging the cartridge rearwardly against the first arm of the tool whereby the tool rotates about the pin until the second arm of the tool contacts a protrusion of the housing at a point of contact; and urging the cartridge further rearwardly against the first arm of the tool whereby the tool rotates about the point of contact and the pin moves forwardly and upwardly along the path so that the first arm of the tool is withdrawn from the uppermost cartridge space allowing the cartridge to occupy the uppermost cartridge space.

13. An apparatus for loading cartridges into a magazine, comprising:

a housing having a top end and a bottom end, the housing comprising a plurality of wall portions defining a housing cavity with an upper loading opening proximate the top end and a lower opening proximate the bottom end, the housing cavity configured to receive an upper portion of the magazine, the housing cavity extending along a magazine insertion and withdrawal axis, the plurality of wall portions comprising a starboard wall portion and an opposing port wall portion, the wall portions defining opposing arcuate pin receiving channels;

a tool disposed between the starboard wall portion and the port wall portion, the tool comprising a central portion defining a bore, a first arm extending away from the bore and a second arm displaced forwardly from the first arm;

the tool comprising a starboard flange and a port flange, both flanges extending upward from the central portion of the tool body, the starboard flange and the port flange being disposed on opposite sides of a notch, the notch being defined by an inner surface of the starboard flange, and an inner surface of the port flange, and a central surface of the central portion, the central surface extending between the inner surface of the starboard flange and the inner surface of the port flange;

the starboard flange defining a starboard bore disposed on a starboard side of the notch, the starboard bore fluidly communicating with the notch;

the port flange defining a port bore disposed on a port side of the notch, the port bore fluidly communicating with the notch;

a spring comprising a length of wire, the wire of the spring forming a first leg, a second leg and a coil disposed between the first leg and the second leg, the coil being disposed between the starboard flange and the port flange, the coil defining a lumen;

the wire forming a foot extending in the starboard direction from the second leg and a bend disposed between the second leg and the foot, the bend being configured so that the foot of the spring extends in the starboard direction;

the foot of the spring extending into a socket defined by a boss, the boss being supported by the starboard wall portion and the boss extending away from the starboard wall portion in the port direction, the first leg of the spring seating against the central surface of the tool;

a pin extending through the starboard bore defined by the starboard flange, through the lumen defined by the coil and through the port bore defined by the port flange, the coil of the spring being disposed about the pin and located within the notch;

the pin having a starboard end and a port end, the starboard end of the pin being disposed inside a starboard channel, the starboard channel being defined by two starboard ribs, the starboard ribs both being supported by the starboard wall portion, the starboard ribs extending in the port direction away from the starboard wall portion, the starboard ribs being offset from one another so as to define the starboard channel, the starboard channel being dimensioned to receive the starboard end of the pin and configured to constrain translation of the starboard end of the pin to a curved starboard path;

the port end of the pin being disposed inside a port channel, the port channel being defined by two port ribs, the port ribs both being supported by the port wall portion, the port ribs extending in the starboard direction away from the port wall portion, the port ribs being offset from one another so as to define the port channel, the port channel being dimensioned to receive port end of the pin and configured to constrain translation of the port end of the pin to a curved port path;

the spring applying a force between the starboard wall portion and the tool so that the tool is biased to move in a generally rearward direction along the curved paths defined by the port and starboard channels; and the spring applying a moment between the starboard wall portion and the tool so that the tool is biased to rotate about the pin so that a distal end of the arm swings forward.

14. The apparatus of claim 13, further comprising a lever disposed inside the cavity.

15. The apparatus of claim 14, wherein the lever is pivotally mounted on an axle.

16. The apparatus of claim 15 wherein a starboard end of the axle is supported by the starboard shell and a port end of the axle is supported by the port shell.

17. The apparatus of claim 13 wherein when a cartridge is inserted through the upper loading opening, the cartridge effects a rearwardly directed force to the first arm of the tool causing the tool to rotate about a pin axis until the second arm of the tool contacts a protrusion of the housing and further application of the rearwardly directed force to the first arm causes the pin to move forwardly and upwardly along the path thereby withdrawing the first arm from the uppermost cartridge space allowing the cartridge to occupy the uppermost cartridge space.

18. The apparatus of claim 13 further comprising a spring loaded lever that urges the magazine rearwardly in the housing.

19. The apparatus of claim 13 further comprising a lever disposed inside the cavity defined by the housing for urging the magazine against a front housing wall portion, the lever being pivotally supported by an axle, the axle extending into a first hole defined by the starboard wall portion and a second hole defined by the port wall portion, the spring comprising a length of wire, the wire of the spring forming a first leg, a second leg and a coil disposed between the first leg and the second leg, the coil defining a lumen, the first leg of the spring being seated against the lever and the second leg of the spring being seated against the housing, the axle extending through the lumen disposed between the first leg and the second leg.

20. The apparatus of claim 13 wherein each channel has an arcuate shape.

* * * * *